US008596921B2

(12) United States Patent
Albro

(10) Patent No.: US 8,596,921 B2
(45) Date of Patent: Dec. 3, 2013

(54) INTERLOCKING BALLAST BLOCK

(76) Inventor: Henry S. Albro, West Townsend, MA (US)

( * ) Notice: Subject to any disclaimer, the term of this patent is extended or adjusted under 35 U.S.C. 154(b) by 257 days.

(21) Appl. No.: 13/106,093

(22) Filed: May 12, 2011

(65) Prior Publication Data

US 2011/0280659 A1 Nov. 17, 2011

Related U.S. Application Data

(60) Provisional application No. 61/334,800, filed on May 14, 2010.

(51) Int. Cl.
*B65D 88/00* (2006.01)

(52) U.S. Cl.
USPC ..... 405/229; 405/256; 405/257

(58) Field of Classification Search
USPC ..... 405/229, 249, 251, 252, 256, 257; 249/99, 101, 106
See application file for complete search history.

(56) References Cited

U.S. PATENT DOCUMENTS

| | | | | |
|---|---|---|---|---|
| 3,451,553 | A * | 6/1969 | Davis | 210/170.08 |
| 4,189,252 | A * | 2/1980 | Inman | 405/33 |
| 5,752,315 | A * | 5/1998 | Sleasman et al. | 29/888 |
| 7,624,892 | B2 * | 12/2009 | Daley et al. | 220/565 |
| 2001/0036387 | A1 * | 11/2001 | Richter et al. | 405/195.1 |
| 2005/0103062 | A1 * | 5/2005 | Wirthwein et al. | 68/19 |
| 2006/0260993 | A1 * | 11/2006 | Daley et al. | 210/173 |
| 2008/0155929 | A1 * | 7/2008 | Herron | 52/582.1 |
| 2010/0213199 | A1 * | 8/2010 | Daley et al. | 220/565 |

OTHER PUBLICATIONS

EOne Sewer Systems, "E/One Extreme Series: DH071 & DR071 Typical Installation Instructions & Warranty Information", manual, Jul. 19, 2007, 20 pgs.
EOne Sewer Systems, "E/One Extreme Series: Pressure Sewer Systems", brochure, 6 pgs.
EOne Sewer Systems, "E/One Extreme Series: WH101/WR101", manual, Jul. 13, 2007, 8 pgs.
EOne Sewer Systems, "E/One Extreme Series: WH101F/WR101F", manual, Jul. 16, 2007, 8 pgs.
Photo of "Ballast", taken on Jul. 1, 2010 in Mattapoisett, Massachusetts.
Photo of "Ballast" taken in 1999.
Photo of "Group of Pump Units" taken on Dec. 31, 2007 in Stockbridge, Massachusetts.
Photo of "Maneuverable Ballast Blocks" taken on Dec. 29, 2005 in Marion, Massachusetts.

* cited by examiner

*Primary Examiner* — Benjamin Fiorello
(74) *Attorney, Agent, or Firm* — Maine Cernota & Rardin

(57) ABSTRACT

A ballast system is provided for use with least partially buried pre-formed chamber, the system having at least one ring formed of a plurality of interlocking ballast block ring segments; each ring segment being configured with at least one male interconnect and at least one female interconnect, each said female interconnect being configured to receive a corresponding male interconnect, each ring segment comprising a containment form shell and cast mass; and corrosion resistant locking pins whereby each female interconnect is secured to a corresponding male interconnect.

17 Claims, 30 Drawing Sheets

INTERLOCKING BALLAST BLOCK

RELATED APPLICATIONS

This application claims the benefit of U.S. Provisional Application No. 61/334,800, filed May 14, 2010. That application is herein incorporated by reference in its entirety for all purposes.

FIELD OF THE INVENTION

The invention relates to ballast block system for subterranean basins and chambers, and more particularly, to an interlocking ballast block system.

BACKGROUND OF THE INVENTION

Grinder pump and STEP (septic tank effluent) stations have been manufactured in fiberglass and high density polyethylene (HDPE) basins for over 40 years. The most recent basin material used has been the HDPE ribbed pipe material similar to that used for storm water drainage culvert pipe.

All of these pump stations are designed to be installed in the ground with exception of a few indoor stations that may sit on the basement floor or in some cases must be installed below ground within the basement level. These stations are made of molded or welded pieces of molded sections of HDPE material. This material is used because it is easy to shape and mold, it is non-corrosive and has a very long life expectancy. The HDPE material provides for a very light weight basin that is easier and less costly to produce, ship and to install. Therefore, most of the grinder pumps and STEP pump basins require anti-flotation ballast to be added to the weight of the station to overcome the uplift forces of a wide range of potential groundwater levels.

Manufacturers of these stations have developed very detailed instructions regarding the proper amount of ballast required in size, shape and weight. These instructions are provided to installers of all ranges of capabilities to produce themselves after the product is delivered for installation. The ballast requirements are typically small quantities of less than 450 pounds containing less than 3 cubic feet of concrete material. The instructions describe a round form around the base with an outside radius of 36 inches and a height of 10.0 inches. The installer must provide such a form to manufacture this ballast ring in the field that will securely encase the shape of the pump basin.

FIG. 1, an illustration from one set of such instructions shows the shape of the form typically in an earthen formed shape.

Typical concrete used in the construction industry has a density of 150 pounds per cubic foot of volume. Uplift forces of ground water or ballast uplift forces are based on the density of water at 62.4 pounds per cubic foot. The resulting benefit of concrete is taken from the density in air value of 150 lb/cu. ft. less the density of water of 62.4 lb/cu. ft. This results in a net gain of 87.6 pounds per cubic foot.

The relatively small requirement of concrete for each station of less than 3.0 cubic feet poses a problem with regards to purchase of pre mixed or sometimes called ready-mixed concrete of uniform strength and consistency. Most concrete suppliers require a 5.0 cubic yard (135.0 cubic feet) minimum order. This then requires the coordination of installations of several pump stations at one time to meet this minimum order requirement, or coordination with other needs for concrete on the site. Concrete mixer trucks are able to get to most sites but are limited in access and can require greater care to reach a remote pump station location. Many pump installations occur in back yards with limited access that limits these trucks to reach the installation. Concrete must then be conveyed by wheel barrow or buckets adding to the labor effort.

These added costs and coordination will most likely force the installer to seek other means such as pre-mixed bag mix which requires field mixing and handling. Special care must be taken to assure proper mixing and uniform consistency of the material to provide the proper compressive strength concrete to reach the required ballast results.

Varying soil conditions and groundwater conditions make the forming of earthen forms of the precise shape and dimensions problematic. This can greatly impede the proper placement of concrete ballast that is of sufficient size and combined strength to properly secure these basins. Installers are often times faced with the challenge of how to secure the station from uplift forces during the time required for the concrete to set or cure to proper strength to complete the excavation. This can result in a great deal of extra time for manpower and machinery needed to complete this pump station installation.

Pouring a wider concrete earthen area can result in a negative gain unless additional concrete is also provided to offset the density of water forces described above. This method of installation is more costly with added concrete material needed and typically requires more time and handling of this added material.

The manufacturer's ballast computations allow for the weight of the backfill soil on top of the concrete ballast ring. This then requires the concrete to be fully cured to provide the strength to secure the pump station. This is especially critical if the station is installed under very high groundwater conditions. Uplift forces on the station can be imposed almost immediately after the station is backfilled. In such systems it is, therefore, imperative that the ballast ring be secure at the time of installation. This condition will require that the ballast ring be pre-cast onto the station prior to installation.

Many attempts at field constructed forms have been used by industrious installers. These forms can be made of wood, plywood, concrete well tiles, sections of plastic (PVC) pipe or HDPE or corrugated metal pipe have also been used. Some of these forms are made to be reused and others may be left in place. These methods can be very successful if done with care and attention to detail. They all require added time, manpower, and equipment to be completed. These measures are best taken well in advance of the actual installation and require pre-planning by the installer. Concrete typically requires a minimum of 7-14 days to reach proper strength to permit the movement of the structure. There are special add mixes and variations of concrete materials that can be used to increase the strength and reduce the set time. These materials are not commonly found at typical building supply and hardware outlets. These materials also require special knowledge and expertise to properly achieve the desired results.

Pre-casting a concrete ballast ring in controlled environments requires a means or method to then lift the entire structure of ballast and pump station and transport them to the installation location. Lifting hooks of sufficient size are required to provide strong lift points that are balanced and stable to support the pump station. Added concrete is usually required to provide support for this transport of the combined structure. FIG. 2 is an elevation view illustrating such an installation of the entire structure.

When properly made, a pre-cast ballast ring can greatly expedite the actual field installation in a wide range of soil and groundwater conditions. The pre-cast ballast ring provides the immediate advantage of securing the station as soon as the backfill soil is placed and compacted in sufficient manner to meet the manufacturer's requirements.

What is needed, therefore, are techniques for precasting of ballast rings in safe, readily installed configurations.

SUMMARY OF THE INVENTION

One embodiment of the present invention provides a system for providing ballast to an at least partially buried preformed chamber, the system comprising: at least one ring formed of a plurality of interlocking ballast block ring segments; each ring segment being configured with at least one male interconnect and at least one female interconnect, each female interconnect being configured to receive a corresponding male interconnect, each ring segment comprising a containment form shell and cast mass; and corrosion resistant locking pins whereby each female interconnect is secured to the corresponding male interconnect.

Another embodiment of the present invention provides such a system wherein the containment form shell comprises high density polyethylene.

A further embodiment of the present invention provides such a system wherein the containment form shell comprises composite resin PVC.

Yet another embodiment of the present invention provides such a system wherein the containment form shell comprises a blow molded thermoplastic resin.

A yet further embodiment of the present invention provides such a system wherein further comprising a placement handle.

Still another embodiment of the present invention provides such a system wherein the placement handle comprises a removable ring received in a lifting bolt disposed within the cast mass.

A still further embodiment of the present invention provides such a system further comprises a conforming profile disposed about an internal circumference of the at least one ring conforming to a sidewall of the preformed chamber.

Even another embodiment of the present invention provides such a system wherein the containment form has an aperture in a top wall for the introduction of casting material into the containment form.

An even further embodiment of the present invention provides such a system further comprising an indent in a bottom wall of each the ring segment formed by a projection of the bottom wall into the ring segment.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The invention is susceptible to many variations. Accordingly, the drawings and following description of various embodiments are to be regarded as illustrative in nature, and not as restrictive.

One embodiment of the present invention provides a means to achieve ballast containment while reducing the labor and time required of field constructed devices and to provide consistent product results and performance under varying installation conditions. Additional benefits of such an embodiment are to reduce work required in excavated trench locations to form and handle concrete materials thereby improving worker safety.

Figure 1:
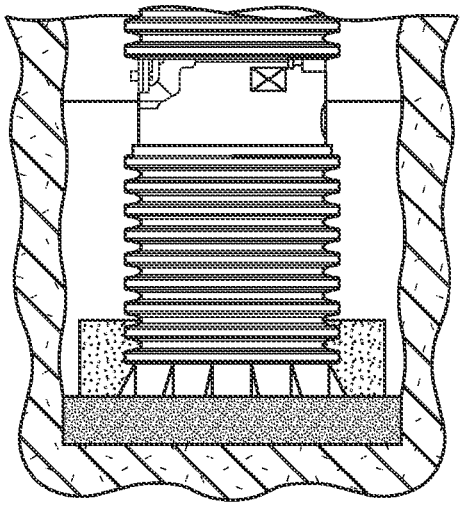
FIG. 1 (PRIOR ART)
FIG. 1 is a cross sectional elevation view illustrating a prior art ballast configuration.
Figure 2:
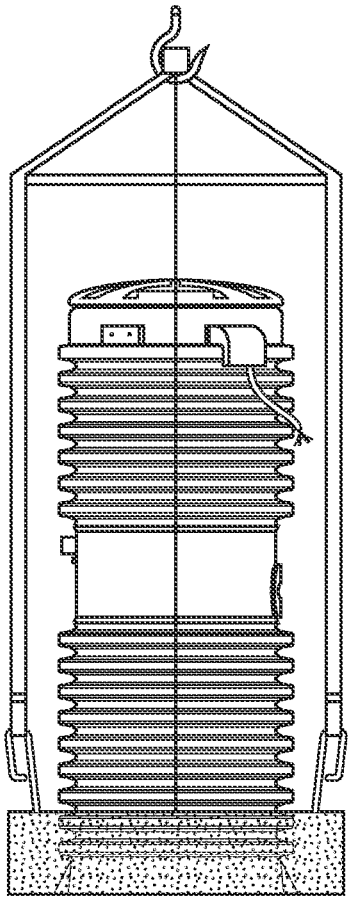
FIG. 2 (PRIOR ART)
FIG. 2 is an elevation view illustrating a prior art ballast installation.
Figure 3:
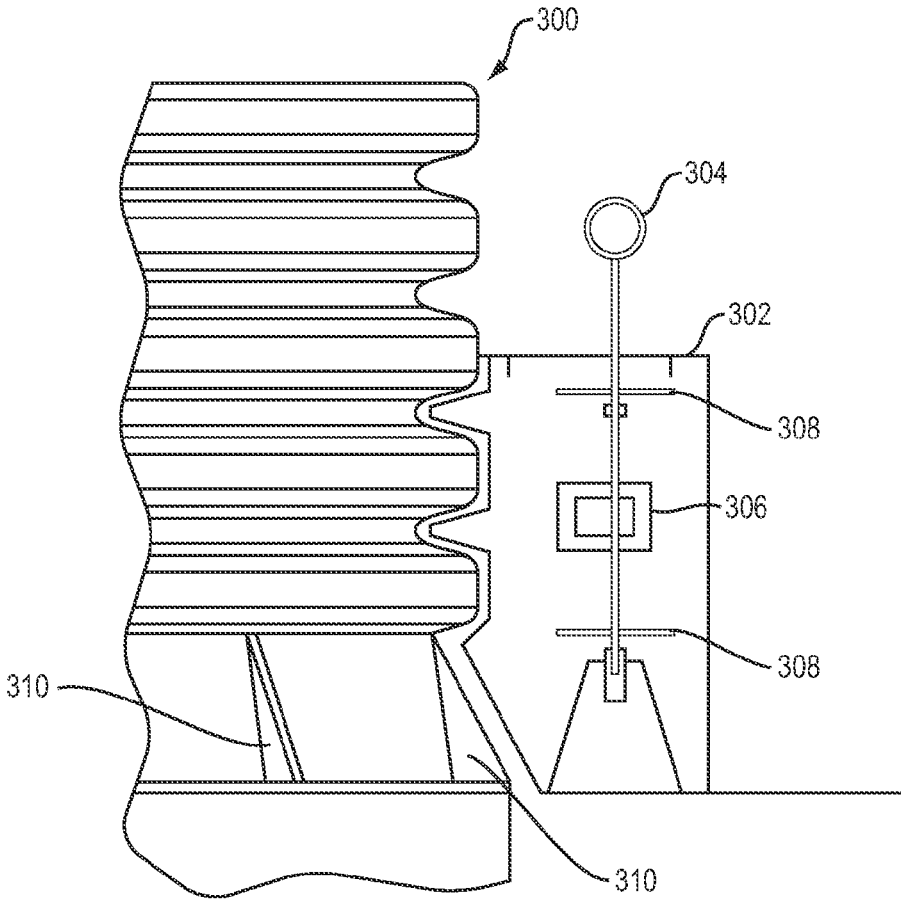
FIG. 3 is a block diagram illustrating a ballast block system configured in accordance with one embodiment of the present invention.
Figure 4:
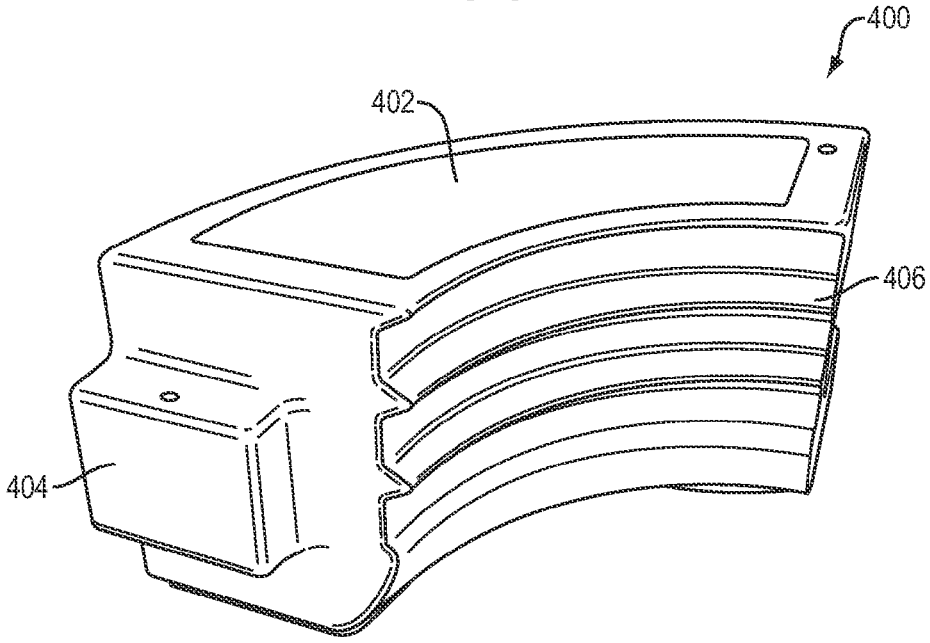
FIG. 4 is a top perspective view illustrating a ballast block form configured in accordance with one embodiment of the present invention.
Figure 5:
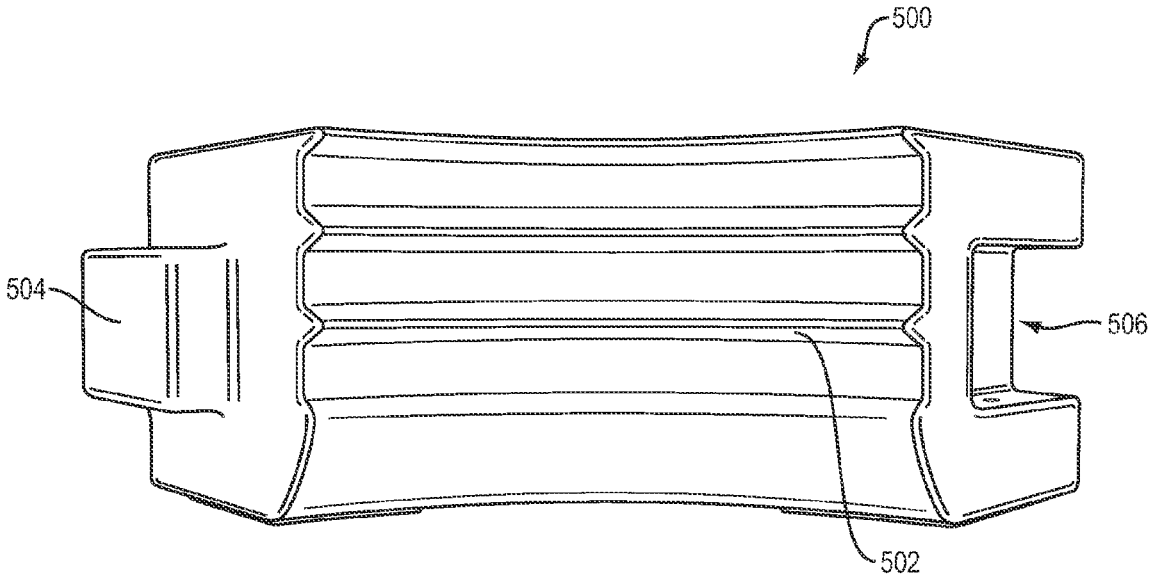
FIG. 5 is an interior perspective view illustrating a ballast block form configured in accordance with one embodiment of the present invention.

As illustrated in FIG. 3, one embodiment of the present invention is a ballast block 302 configured to interlock with the outside wall of the pump stations 300 and have the ability to be interlocked with additional ballast sections to form a complete ballast ring around these stations. The interlocking method is intended to be formed as part of the mold as a so called tongue and grove or slot and pin device 306. The interlocking molded section is to be secured by a stable and solid locking pin with attached lifting hook 304 to prevent shifting or separation of the interlocked blocks after assembly around the grinder pump or Septic Tank Effluent Pump chamber (STEP) pump basin FIGS. 4 and 5 show a top and interior perspective view, respectively, of a ballast block form configured in accordance with an embodiment of the invention. The interlocking ballast block 400 and 500 may be curved in shape to conform to the outer diameter of the sewage grinder pump or STEP 300. The interlocking blocks would be placed around the chamber and each block would interlock using the grove or slot formed recess 506 and the tongue or pin 504. The ballast block would have a male 504 and female end 506 such that one form can be used to make blocks that would encircle the entire sewage grinder or STEP pump.

Figure 6:
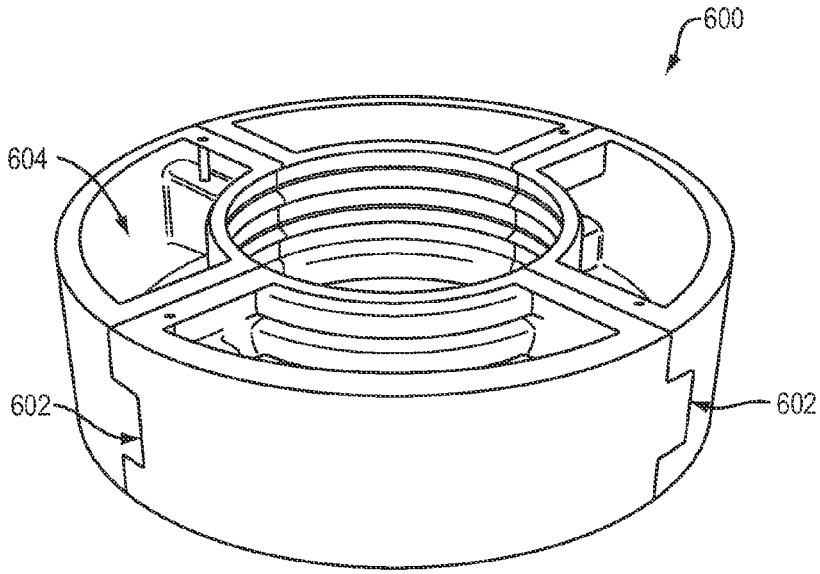
FIG. 6 is a top perspective view illustrating a ballast block form ring configured in accordance with one embodiment of the present invention.

FIG. 6 illustrates, according to an embodiment of the invention, that as the blocks 600 are assembled they would come tighter to a formed stop point 602 and then be pinned together to prevent the blocks from coming apart.

The interlocking ballast block 500 may be formed in a shape to conform to the ribbed outer wall of the sewage grinder or STEP tank wall 300 to securely hold the tank from sliding upward under uplift forces of groundwater. A minimum capture of 2-3 ribs 502 and the base plate gussets 310 on the pump tank may be utilized to secure the pump to the interlock ballast block. The interlock ballast block will be sized to provide the same or greater ballast weight required by the manufacturer as well as provide the same or greater surface area to also enable the use of the soil backfill ballast as permitted by the manufacturer.

According to one embodiment of the present invention the interlocking ballast block will be able to be placed either on the pump before it is placed in the excavated trench or after it is placed. The interlocking ballast block will also be removable and re-usable if the sewage grinder pump or STEP pump chamber must be moved to another location. Removal of the interlocking ballast block will require the removal of the locking pins and then may be separated from the sewage pump chamber or STEP pump chamber by pulling them away from the pump chamber and separating the tongue and groove locking pin.

A lifting device 304 is shown in FIG. 3 with anchoring hardware 308 to be secured by the ballast form prior to placement of the concrete material within the form. The concrete material is intended to provide the strength to secure the lifting hardware for placement of individual blocks in the excavated trench as needed or in combination with other ballast to allow placement of the fully assembled pumping station or STEP pump basin in the excavated trench provided proper safety measures are taken and the ballast system is fully installed and secured with anchoring pins described above and further described in the product descriptions below.

An open top 402 in the ballast form allows the addition of concrete material either by others or as part of the manufacturing process. The concrete will provide the required weight for the ballast requirement as well as the support and strength to provide a solid block with the ability to support the pump basin from uplift forces and to provide the ability to permit placement of the ballast prior to installing the pump basin for installations under saturated groundwater conditions; or as a simple means to place the ballast at the top of the excavation. The ballast configured according to one embodiment of the present invention may be installed on the pump basin either prior to delivery to the installation site, at the installation site above grade or above the excavated trench area or in the excavated trench area provided proper safety measures are taken by the installer to meet OSHA and any other local trench safety regulations.

The ballast form configured according to one embodiment of the present invention provides a smooth outer wall form as well as a level base to sit evenly on the soil bedding material that is required by the manufacturer of the pump basins. The ballast form is designed to be a standard sized form made of injection molded or blow molded material such as PVC or HDPE or other suitable composite resin compilations. The form is not intended to provide the full structural support for the ballast ring and relies on the addition of uniform concrete mix material poured and properly vibrated to fill all voids in the mold. The ballast is intended to be a pre-cast product of specific size and shape which is prepared in advance of the installation of the grinder pump or STEP pump basin and is to be only used after the concrete is fully cured and of sufficient strength.

One skilled in the art will appreciate that other cementations or engineered materials configured with structural integrity may be used within the mold as ballast.

Various embodiments of the present invention are designed to permit stacking on wooden pallets for shipment as complete assemblies. The assembled ballast of one such embodiment may be shipped if properly secured on the wooden pallets as the unit weight may in some instances be expected to exceed 96 pounds (US).

The ballast forms (absent concrete) may be packaged in other suitable containers including stacking on wooden or plastic pallets, or containment in cardboard or plastic boxes provided they are secured and packaged in a manner to protect them from damage.

One embodiment of the present invention may be configured to surround fiberglass tanks or larger basins than those described above.

In one embodiment a stackable ballast block riser (described herein) shall be used to add additional ballast when required to overcome additional ballast forces or as additional support for stations that may require added depth of installation. In an alternative embodiment a second course of stackable ballast block riser shall be made to sit on the flat top surface of a first course of ballast block when the lifting hardware is removed. The second course of ballast block riser may interlock in the same manner as the described above ballast block and be designed to fit around the sewage grinder pump station and STEP or Septic Tank Effluent Pump Station by capturing an additional three (3) rows of corrugations. Additional courses of ballast block risers may be added as necessary.

Figure 7:
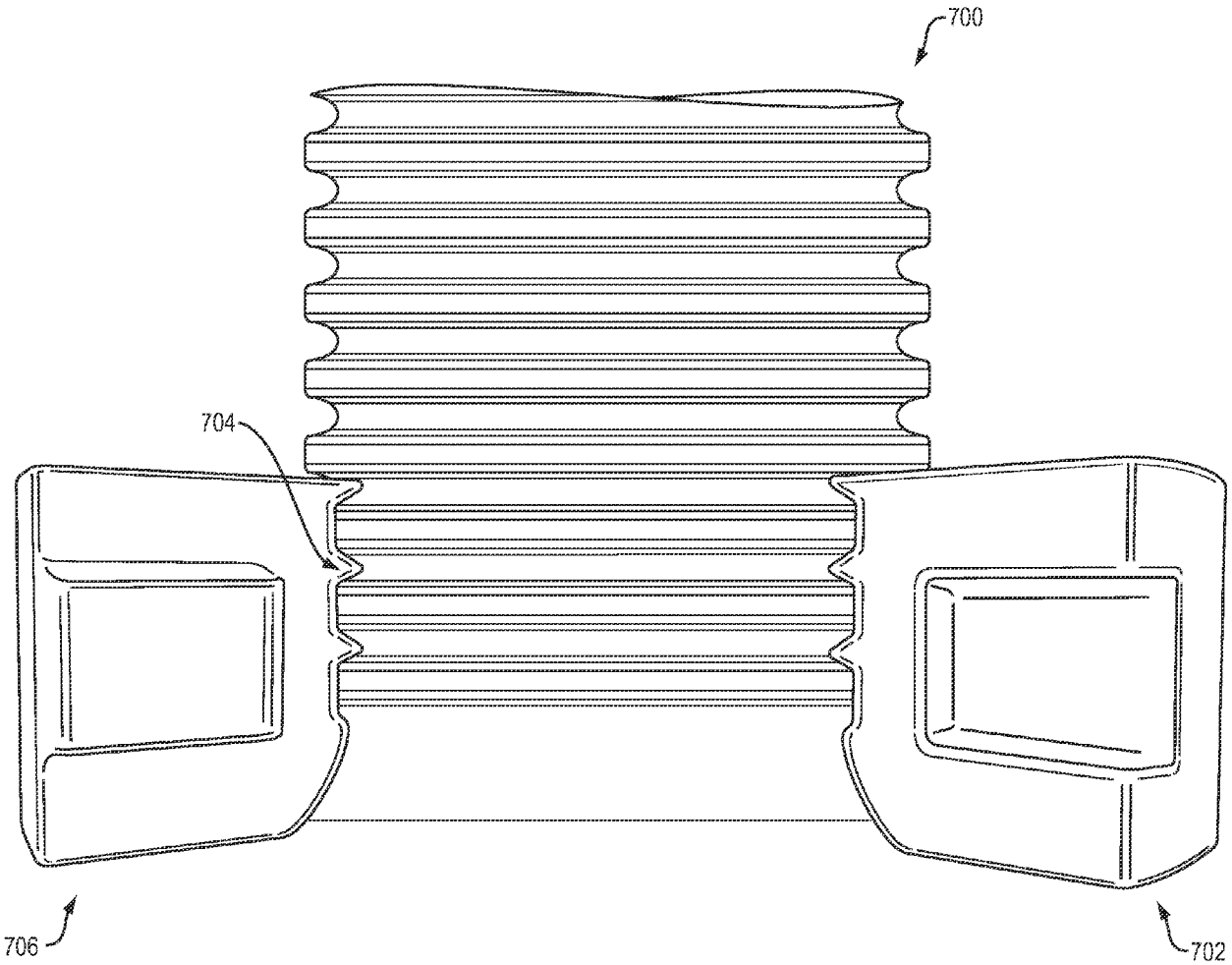
FIG. 7 is a perspective drawing of the interlocking ballast block system gripping the outer wall of the pump basin and configured according to one embodiment of the present invention.

FIG. 7 shows the interlocking ballast block system gripping the outer wall 700 of the pump basin. This image shows the conforming profile 704 conforming to the sidewall of the preformed chamber. Also shown is the male form 706 and female form 702 prior to placement of the last interlocking ballast block.

Figure 8:
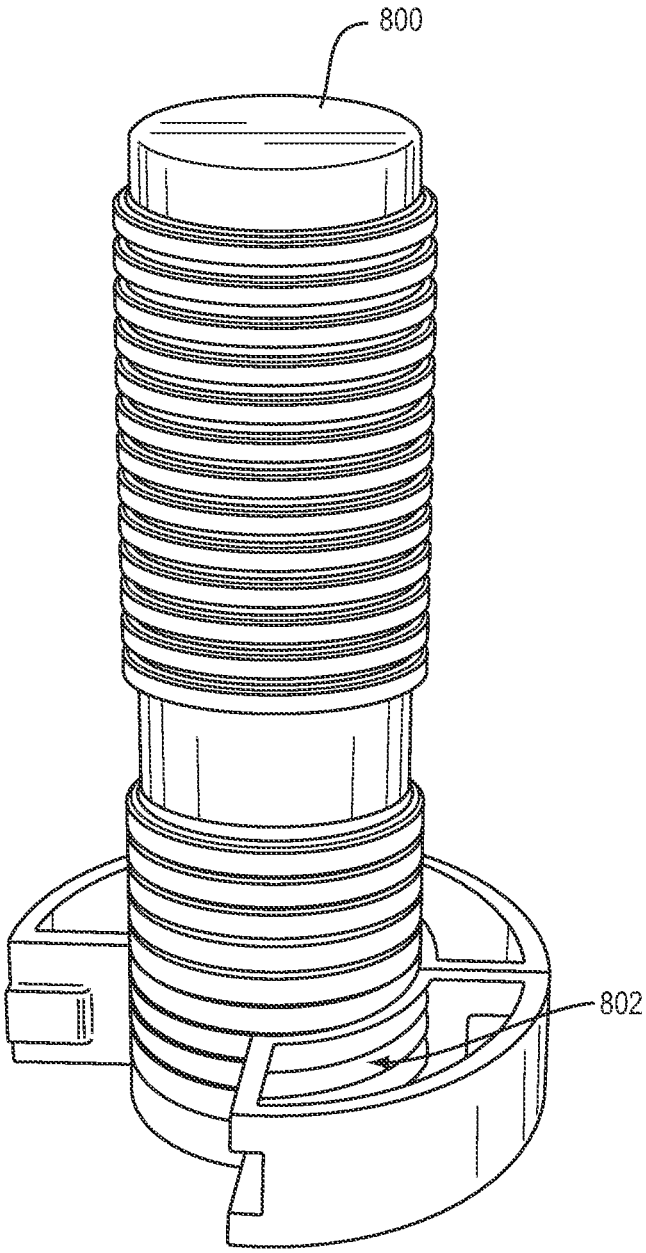
FIG. 8 is a perspective drawing of the formation of a partial ring of interlocking ballast blocks around the preformed chamber and configured according to one embodiment of the present invention.

FIG. 8 shows the forming of a partial ring of interlocking ballast blocks 802 around the preformed chamber 800. The image does not have the ballast fill material so one can see the conforming profile that is part of the ballast block system.

Figure 9:
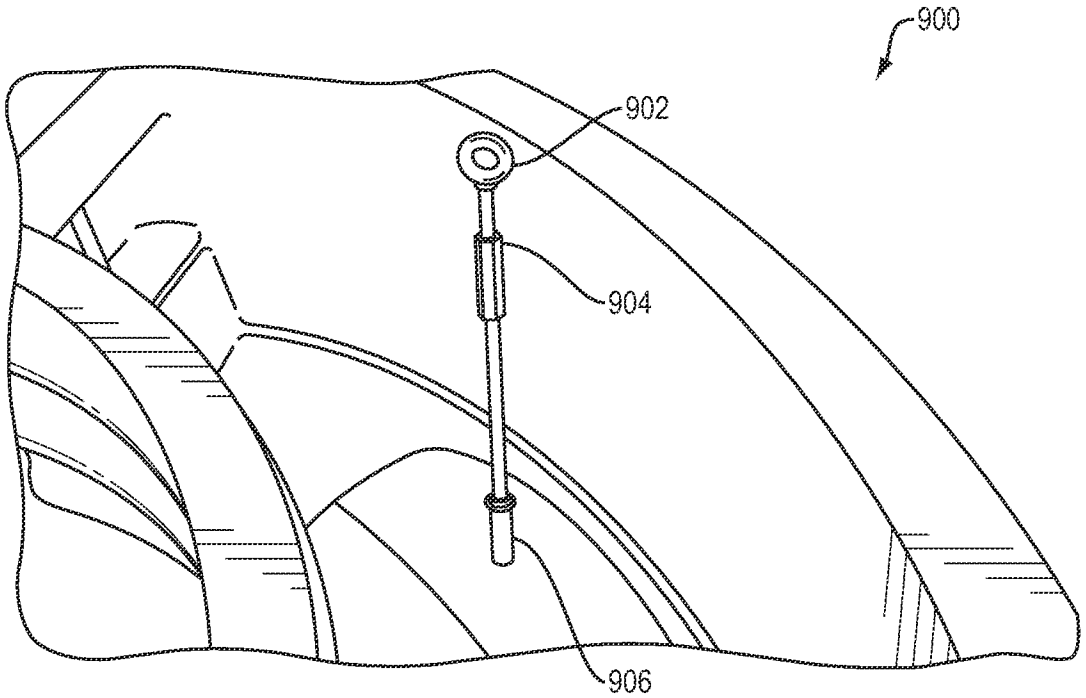
FIG. 9 is a perspective drawing of the mounting of the lifting hardware to the formed ballast block form configured according to one embodiment of the present invention.
Figure 36:
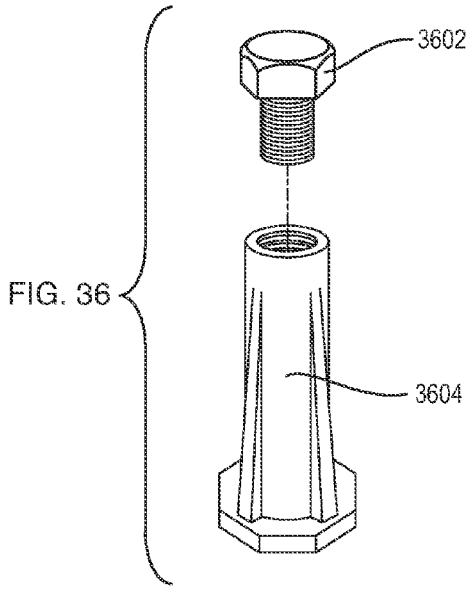
FIG. 36 is a perspective view illustrating an anchoring mechanism configured according to one embodiment of the invention.

FIG. 9 shows the mounting of the lifting hardware to the formed ballast block form 900. The hardware is placed in a sleeve of molded structure 906 and secured to provide stability when the ballast fill material is added. The ballast fill material will be level at the top and encompass the entire hardware leaving only the removable lift ring 902 and locking nut 904 exposed at the very top. As illustrated in FIG. 36, an alternative embodiment may use an anchor 3604 disposed in the cementitious fill material itself, which when hardened secures the anchor 3604. A bolt 3602 may then be used to fasten the anchor to other blocks.

Figure 10:
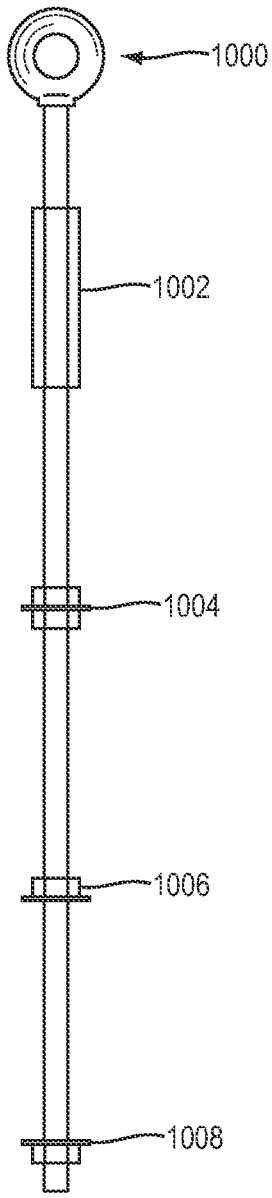
FIG. 10 is a perspective drawing of the anchoring hardware seen in FIG. 9 configured according to one embodiment of the present invention.
Figure 11:
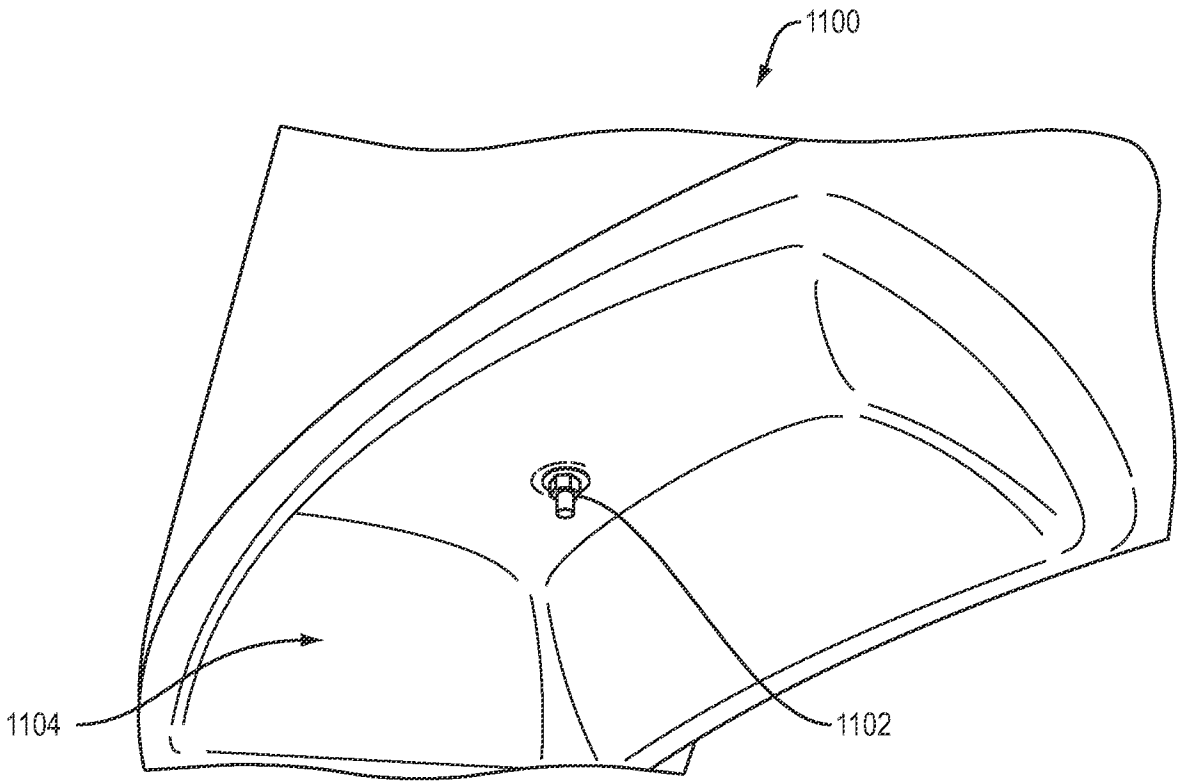
FIG. 11 is a perspective drawing of the bottom of the molded ballast block configured according to one embodiment of the present invention with the indented form to protect the mounting hardware from causing an uneven placement surface.

FIG. 10 shows the anchoring hardware seen in FIG. 9. From the bottom there are a locking nut and washer 1008 that is secured to the bottom of the molded ballast form (FIG. 11). There is another securing nut and washer 1006 that secures the upper portion of the hardware to the top of the internal sleeve of the molded ballast block system (see 906 of FIG. 9). Yet another nut and washer 1004 are added in the mid section of the hardware to provide additional gripping surface for the ballast material when placed. At the upper section of the hardware assembly is a longer coupling nut 1002 that will be flush with the top of the ballast block and ballast material when placed. Connected to the coupling nut is the removable lifting hardware and locking nut 1000.

FIG. 11 shows the bottom of the molded ballast block 1100 with the indented form 1104 to protect the mounting hardware from causing an uneven placement surface. Shown is the bottom anchoring nut and washer 1102 described in FIG. 10 hardware description.

Figure 12:
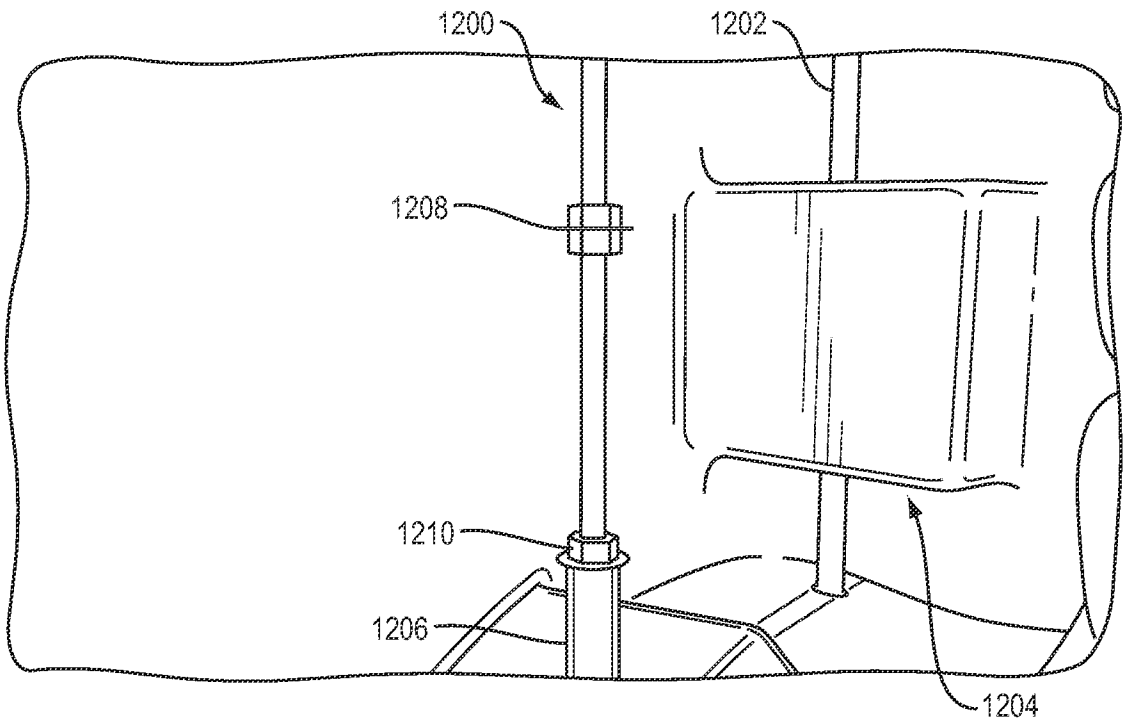
FIG. 12 is a perspective drawing of the internal details of the interlocking block system configured according to one embodiment of the present invention.

FIG. 12 shows much of the internal details of the interlocking block system.

The background (right) shows the internal form of the female molded form 1204 for the interlocking benefits of the system. Shown connecting to this form is the locking pin sleeve 1202 which is molded in a manner to allow ballast material to encircle the sleeve for support while maintaining proper alignment of the locking pin. This sleeve system is also used on the male end of the molded form. See FIG. 13 below.

Also shown in the foreground is the molded hardware sleeve 1206 and anchoring nut and washer 1210 described in FIG. 10 description. Above this nut and washer is a pair of locking nuts and washer 1208 used to provide additional gripping surface for the ballast material to secure the hardware 1200 to the ballast material. Above this gripping nut assembly and out of view is the longer coupling nut which receives the removable lifting ring and locking nut.

Figure 13:
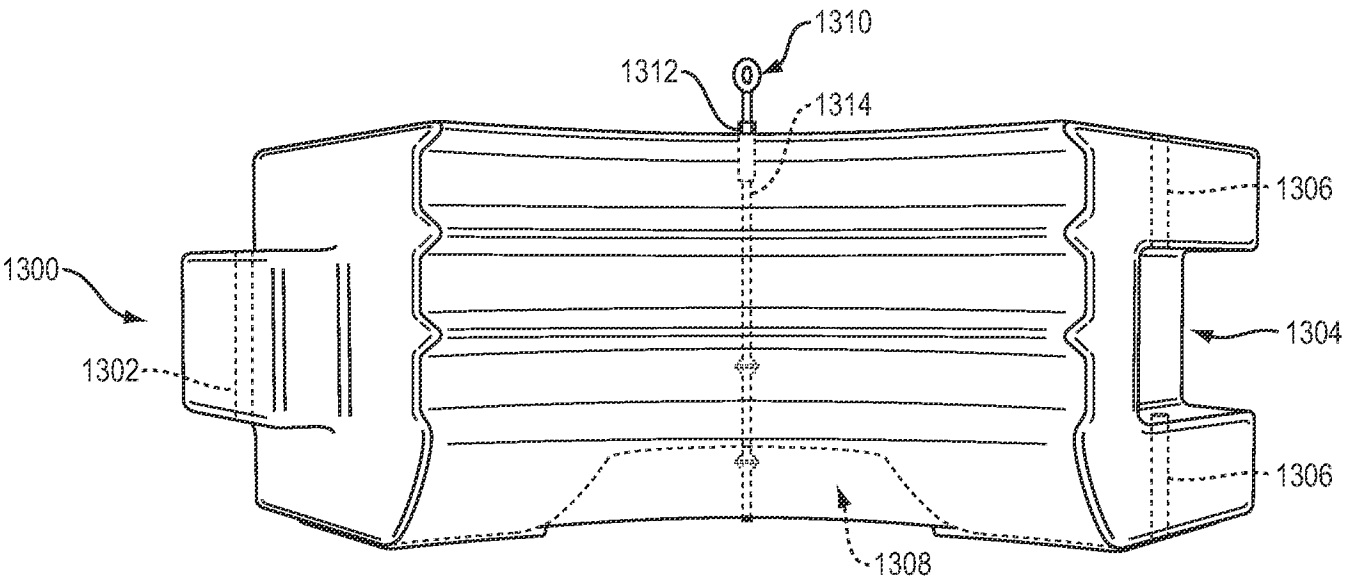
FIG. 13 is a cutaway view of the interlocking ballast block to show the male end with locking pin sleeve molded within the pin configured according to one embodiment of the present invention.

FIG. 13 is a cutaway view of the interlocking ballast block to show the male end 1300 with locking pin sleeve 1302 molded within the pin. At the opposite end one can see the female end 1304 of the interlocking block with the molded locking pin sleeves 1306. In the middle of the interlocking block system is the bottom indent 1308 with the lifting hardware 1314 in place as defined earlier in greater detail. At the top of the lifting hardware one can see the removable lifting ring 1310 that is threaded into the coupling nut 1312 and secured with a locking nut.

Not shown in this detail is the added pair of grip nuts and washer described in FIGS. 10 and 12.

Figure 14:
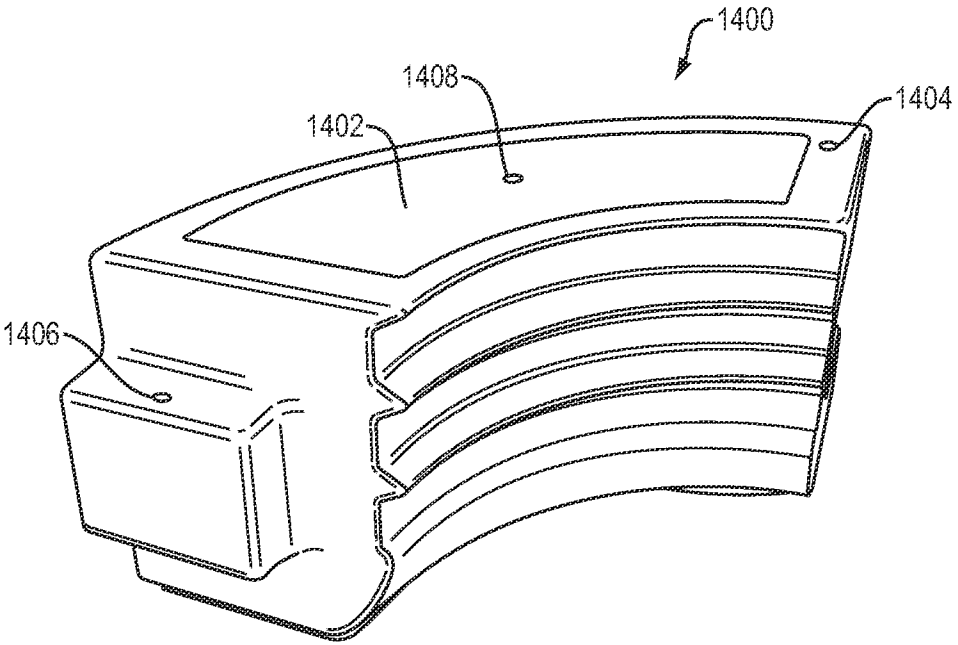
FIG. 14 is a perspective view of the completed ballast block configured according to one embodiment of the present invention with ballast fill material.
Figure 15:
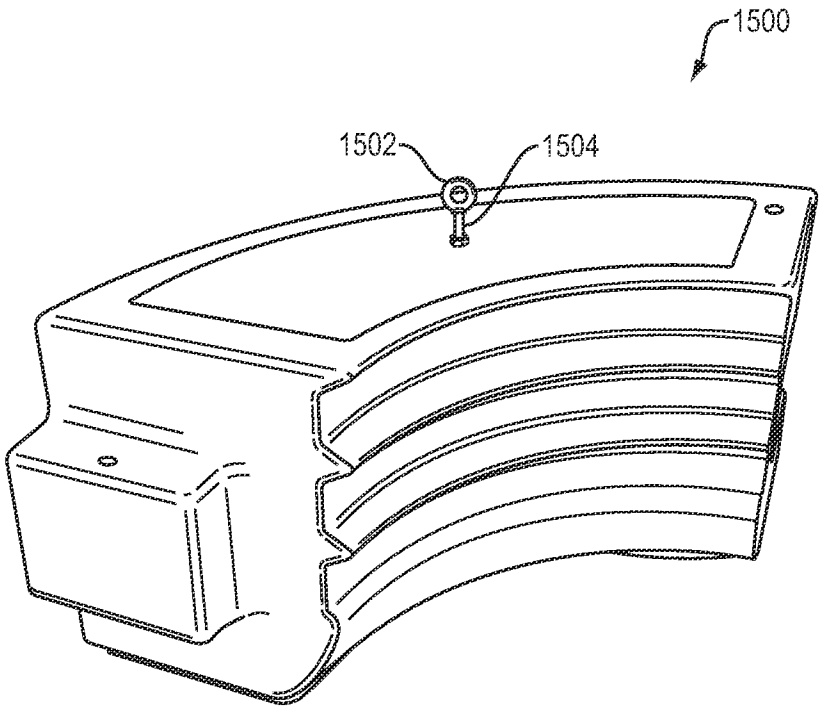
FIG. 15 is a perspective view of the removable lifting ring and locking nut in place and configured according to one embodiment of the present invention.

FIG. 14 shows the completed ballast block 1400 with ballast fill material 1402. Seen in this image are the locking pin slots in the male 1406 and female 1404 ends of the ballast block. The image also shows the lifting hardware coupling nut 1408 flush with the ballast material at the center of the ballast block. FIG. 15 shows the removable lifting ring 1502 and locking nut 1504 in place.

Figure 16:
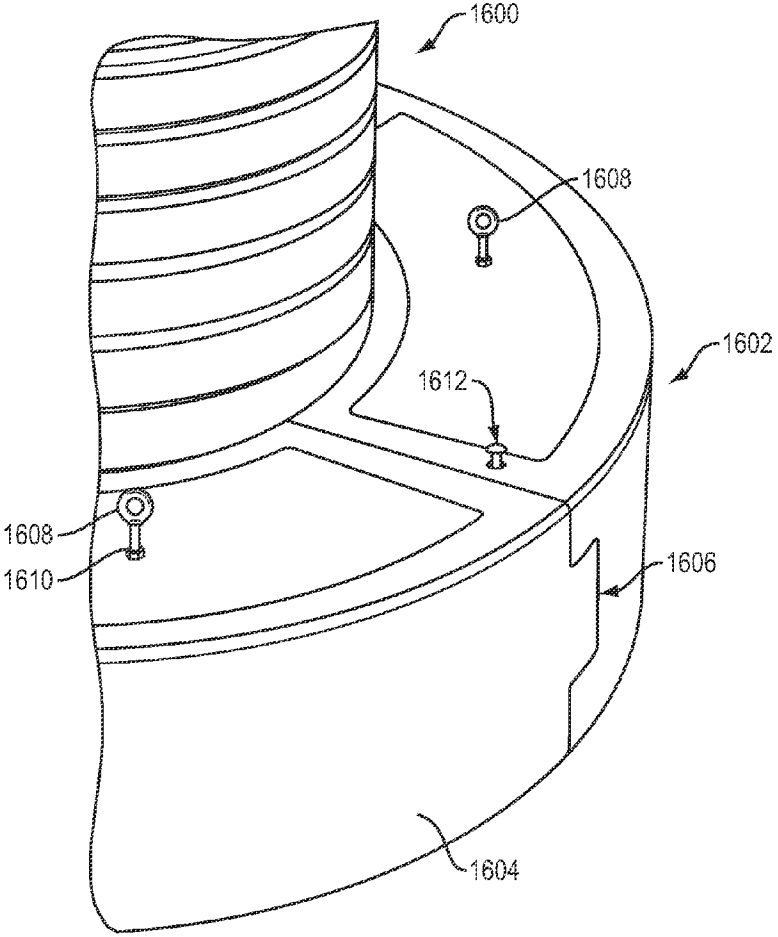
FIG. 16 is a perspective view of the placement of the interlocking ballast blocks around the preformed pump basin and configured in accord with one embodiment of the present invention.

FIG. 16 shows the placement of the interlocking ballast blocks 1602 and 1604 around the preformed pump basin

1600. Shown are lifting rings 1608 and locking nut 1610 in each block and the placement of the locking pin 1612 to secure each block to one another. Shown in the outer form are the locking male and female forms when joined 1606 to form a continuous ring to secure the assembly providing horizontal and vertical interlocking support.

Figure 17:
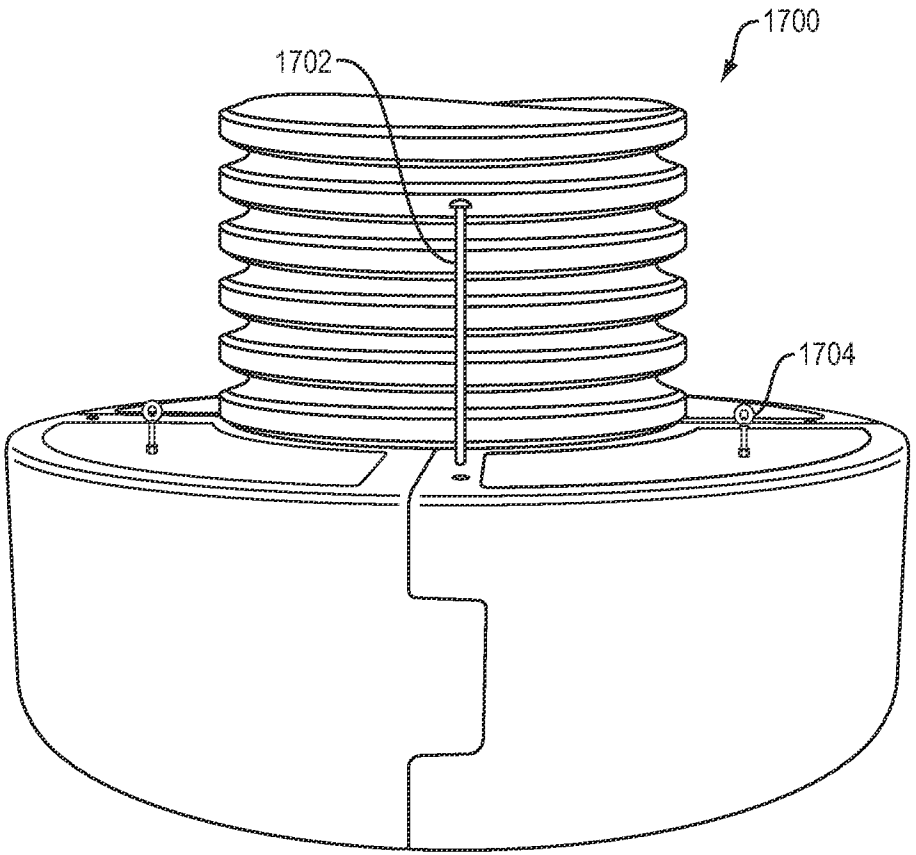
FIG. 17 is a perspective view of the placement of the locking pin to each male and female counterpart that is inserted into the molded sleeves of the formed mold according to one embodiment of the present invention.
Figure 17A:
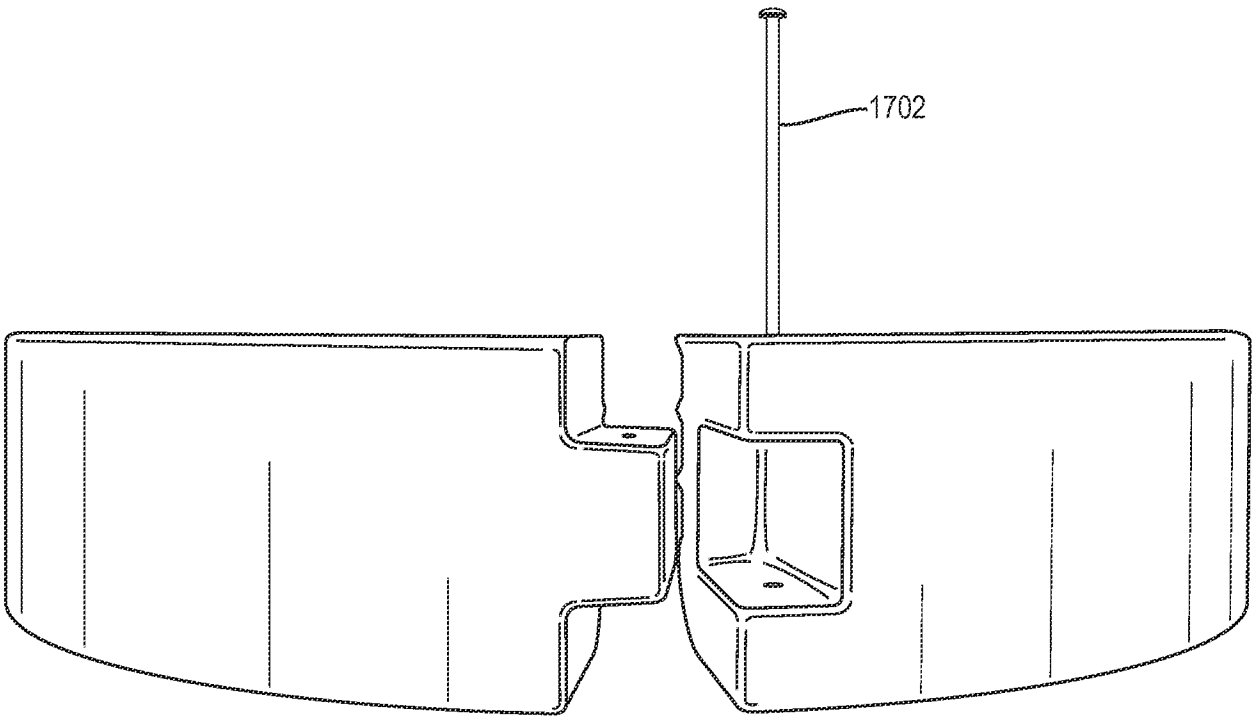
FIG. 17A is a perspective view of the assembly of the locking pin to each male and female counterpart that is inserted into the molded sleeves of the formed mold according to one embodiment of the present invention.

FIG. 17 shows the placement of the locking pin 1702 to each male and female counterpart that is inserted into the molded sleeves of the formed mold. Also shown are the lifting rings 1704. This figure also shows the full placement of a complete ring of interlocking ballast blocks around the pump basin 1700 with greater detail. FIG. 17A shows the placement of the locking pin 1702 to each male and female counterpart prior to joining of the sections.

Figure 18:
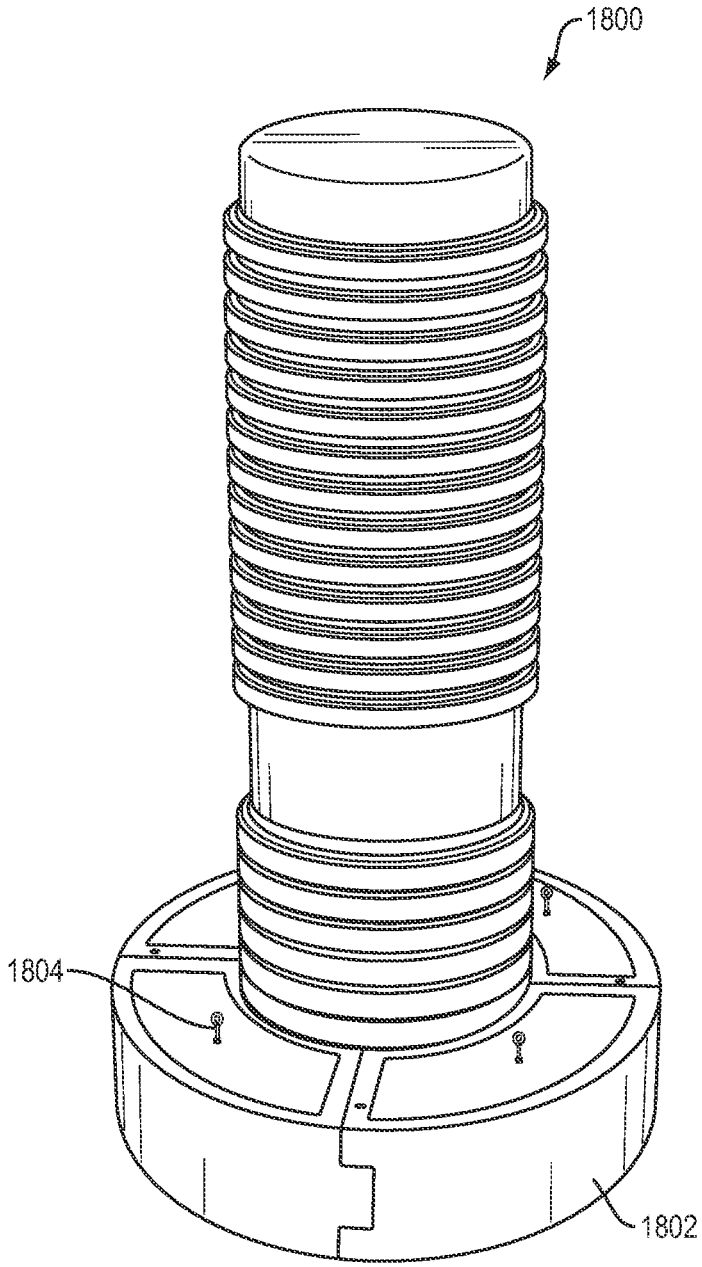
FIG. 18 is a perspective view of the completed placement of the interlocking ballast block system on the preformed pump basin according to one embodiment of the present invention.

FIG. 18 shows the completed placement of the interlocking ballast block system on the preformed pump basin 1800. The system has a complete ring of (4) four interlocking ballast blocks 1802 each with lifting rings 1804 for use in placement of the entire assembly.

Figure 19:
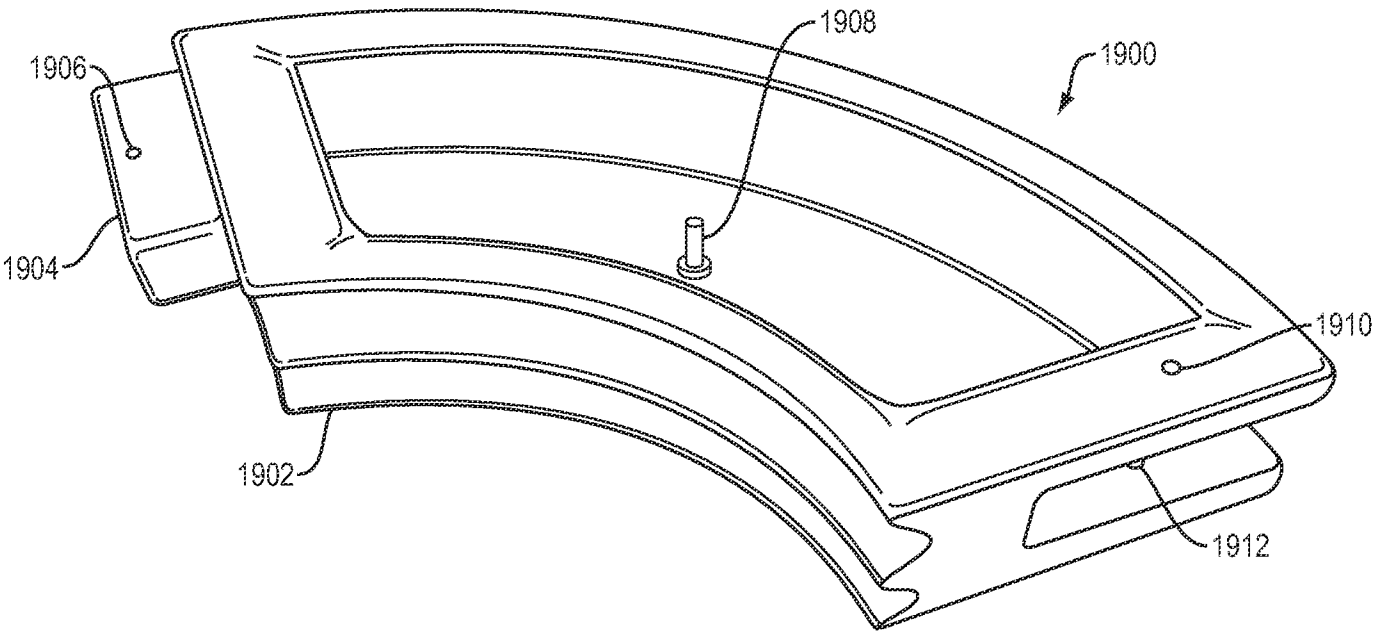
FIG. 19 is a perspective view of the inside of the conforming mold for the stackable riser block which may be added to the interlocking ballast block system according to one embodiment of the present invention.

FIG. 19 shows the inside of the conforming mold for the stackable riser block 1900 which may be added to the interlocking ballast block system to provide additional ballast in difficult soils or may add reinforcing to the station when installed at excessive depths. Shown are male end 1904, female end 1912, conforming profile 1902, molded hardware sleeve 1908 and locking pin sleeves 1906, 1910 and 1912.

Figure 20:
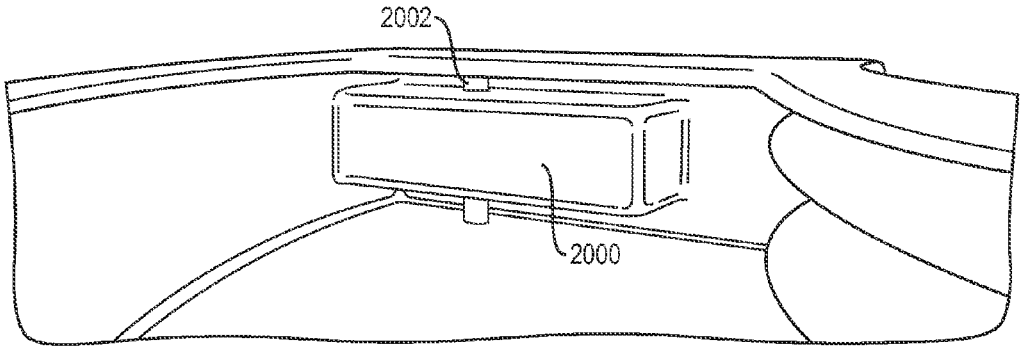
FIG. 20 is a perspective view of the inside conforming mold and female interlocking molded end section also found in the interlocking ballast block system according to one embodiment of the present invention.

FIG. 20 shows the inside conforming mold for the stackable riser block including female interlocking molded end section 2000 and locking pin sleeve 2002 also found in the interlocking ballast block system.

Figure 21:
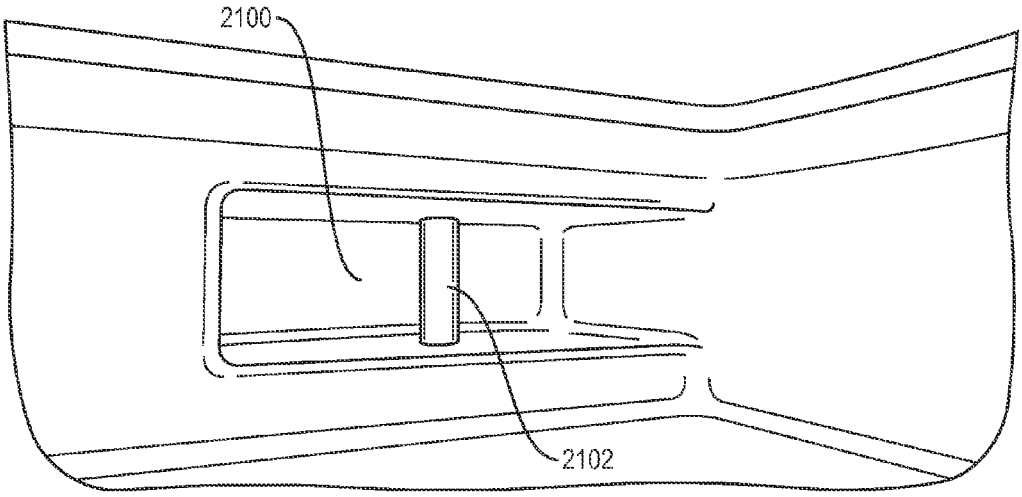
FIG. 21 is a perspective view of the locking pin sleeve in the male end of the riser block according to one embodiment of the present invention.

FIG. 21 shows the locking pin sleeve 2102 in the male end 2100 of the riser block.

Figure 22:
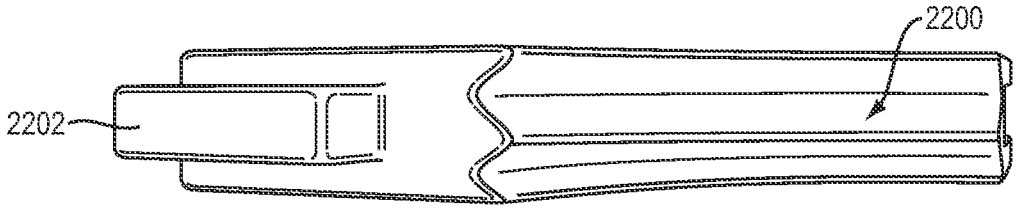
FIG. 22 is a perspective view of the inside conforming form and male end of the riser block according to one embodiment of the present invention.

FIG. 22 shows the inside conforming form 2200 and male end 2202 of the riser block.

Figure 23:
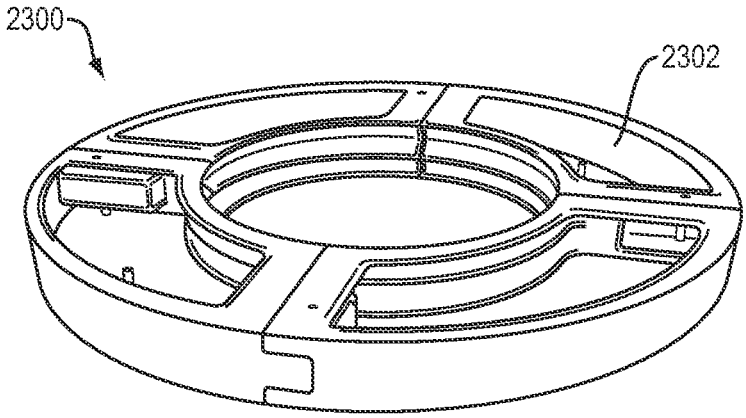
FIG. 23 is a perspective view of the formed system without the ballast fill material according to one embodiment of the present invention.

FIG. 23 shows the formed riser block system 2300 without the ballast fill material 2302.

Figure 24:
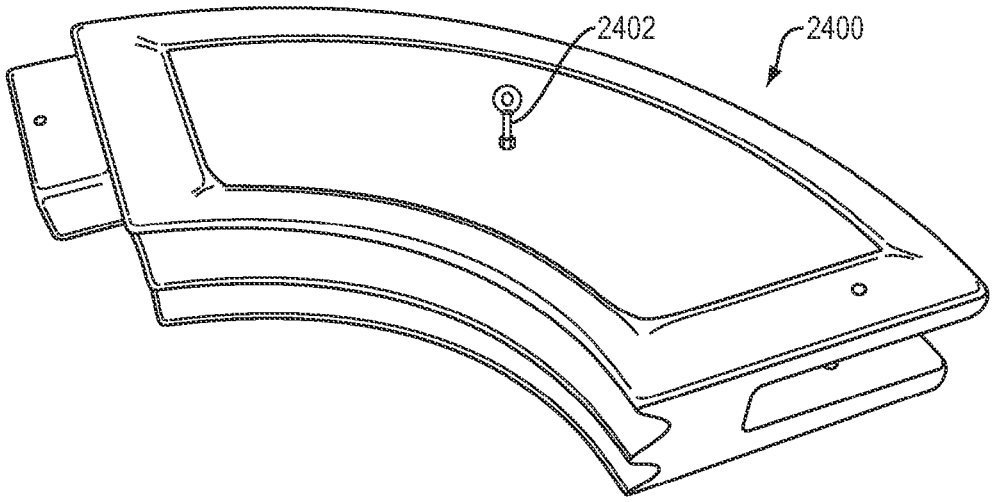
FIG. 24 is a perspective view of the riser block with the ballast fill material and lifting hook according to one embodiment of the present invention.

FIG. 24 shows the riser block with the ballast fill material 2400 and lifting hook 2402.

Figure 25:
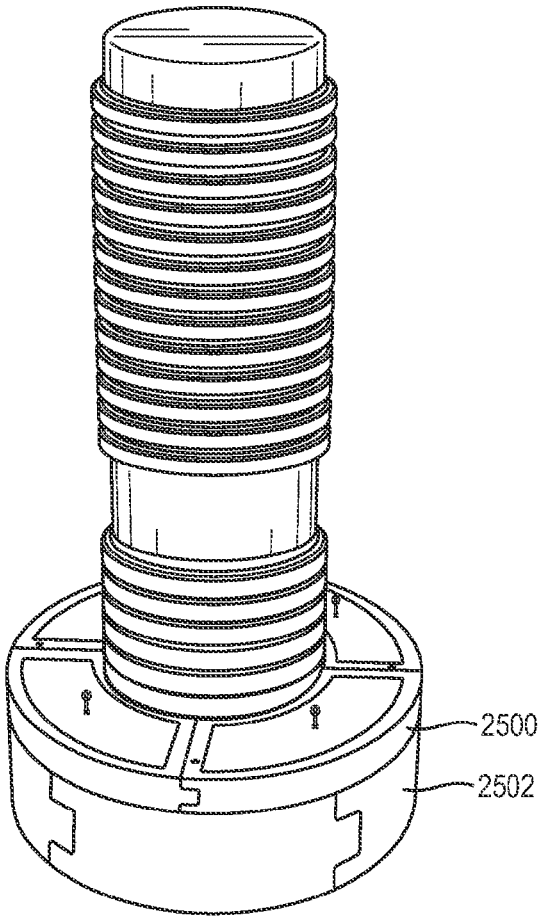
FIG. 25 is a perspective view illustrating courses of four riser blocks added to the ballast block system according to one embodiment of the present invention.

FIG. 25 illustrates courses of 4 riser blocks 2500 may be added to the ballast block system 2502.

Figure 26:
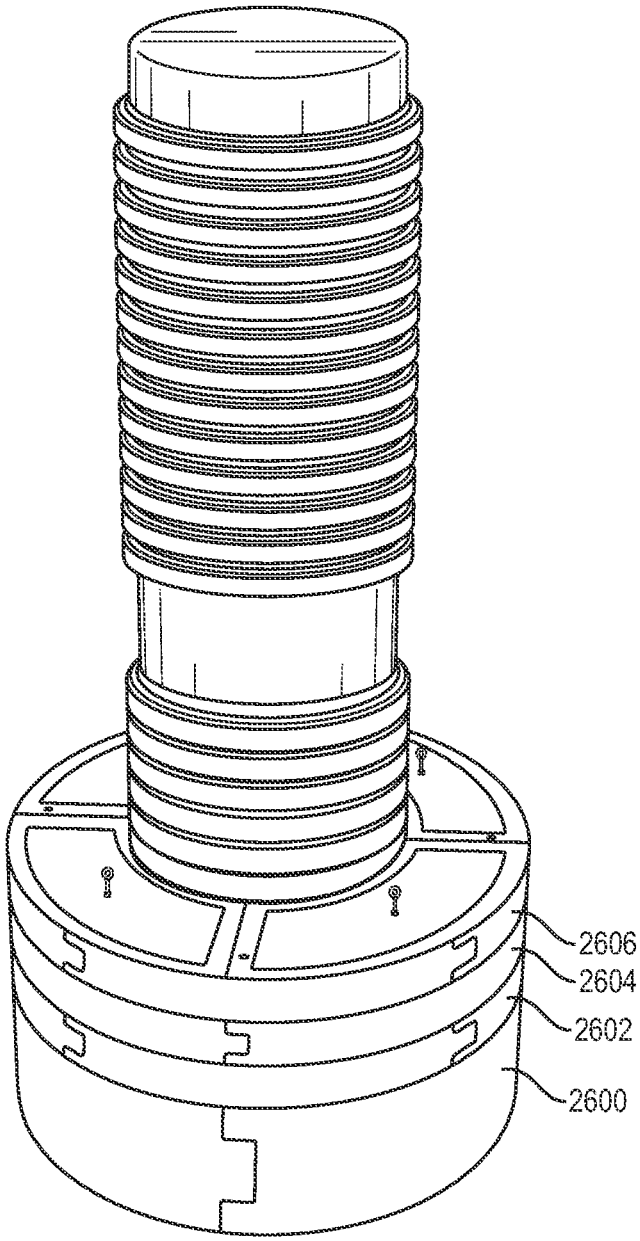
FIG. 26 is a perspective view illustrating an embodiment wherein as many as three courses of four riser blocks may be added to the ballast block system.

FIG. 26 illustrates such a system wherein as many as 3 courses 2602, 2604, 2606 of 4 riser blocks may be added to the ballast block system 2600. The courses are rotated to offset joints for maximum strength.

Figure 27:
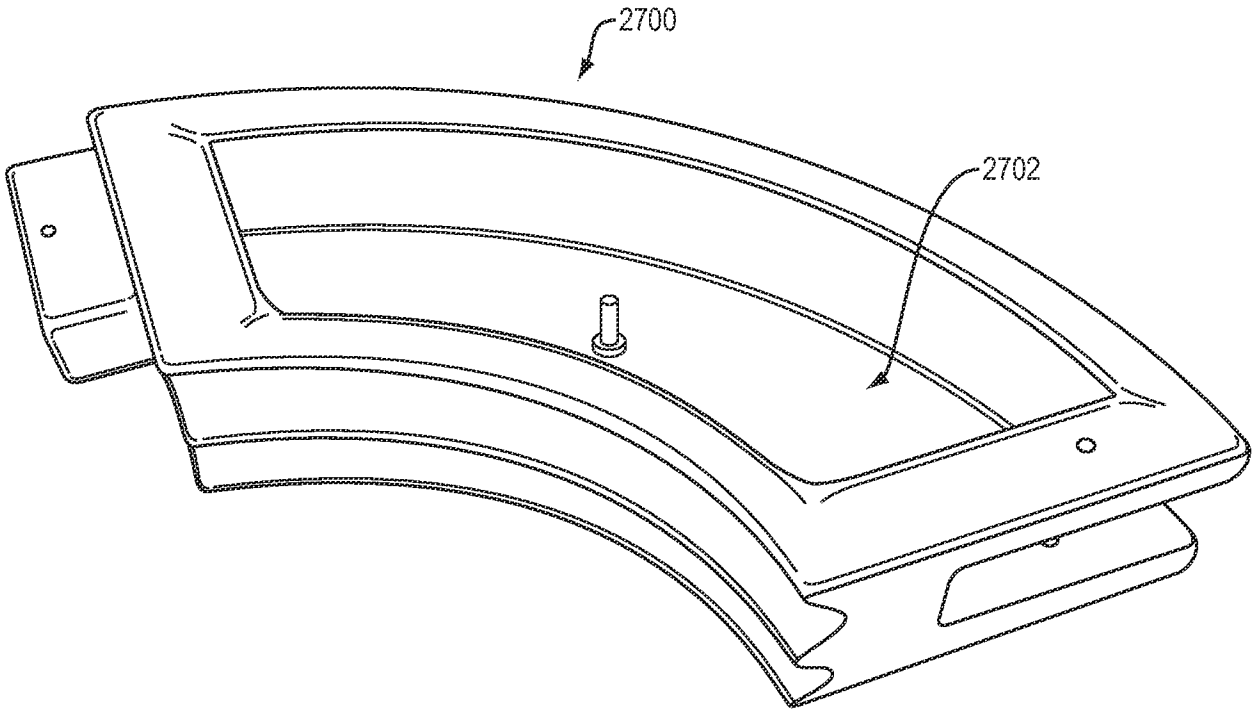
FIG. 27 is a perspective view illustrating a riser block form configured according to one embodiment of the present invention which may be also used for an insulation block for frost protection in cold climates.

FIG. 27 illustrates the riser block form 2700 which may be also used for an insulation block for frost protection in cold climates. The shaped form cavity 2702 may be filled with close celled foam and inverted for placement at the top of the pump chamber. Alternatively the form shape may be totally closed and injection filled with close celled foam. The system will assemble in the same manner as the ballast block and riser block systems.

Figure 28:
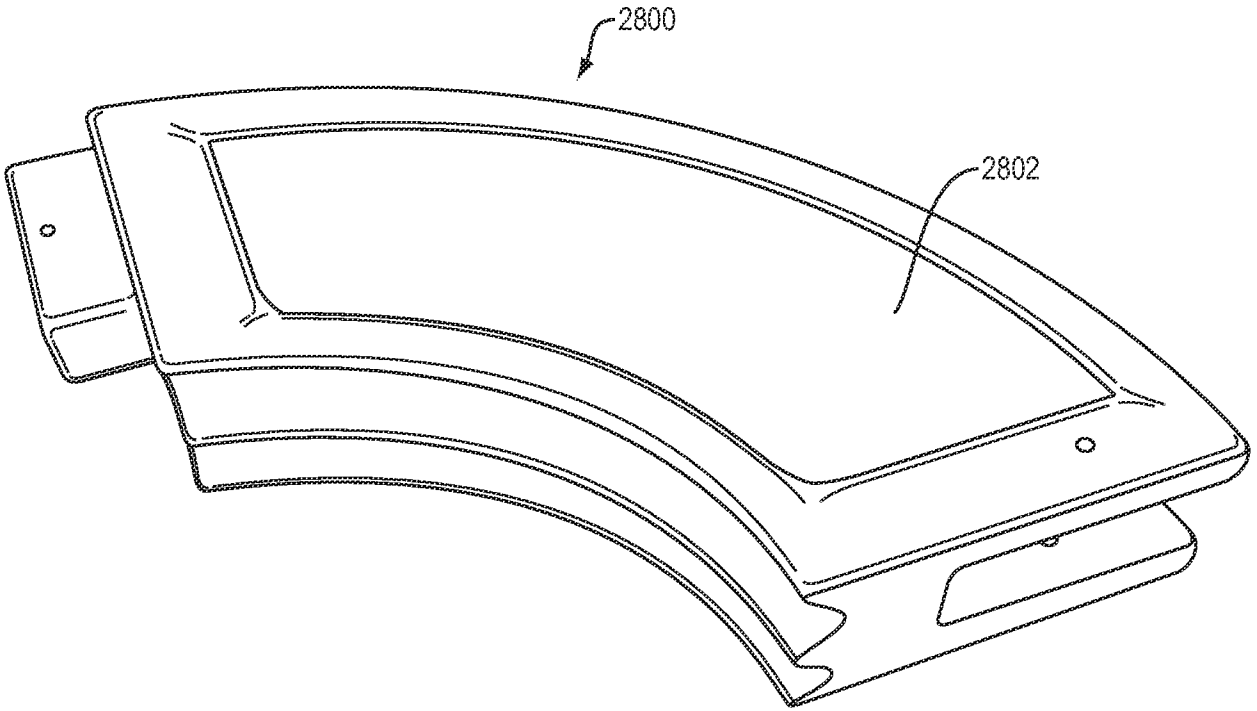
FIG. 28 is a perspective view illustrating the underside of the interlocking insulation block with foam filled form according to one embodiment of the present invention.

FIG. 28 above shows the underside of the interlocking insulation block 2800 with foam filled form 2802. A separate stop plate may be used to control the final surface of the foam to form a smooth and flat surface. The stop plate is placed inside the open form to lock into place with the form and seal the bottom. Foam may also be filled from the larger opening and excess material may be cut away to provide a smooth level surface. As noted above, in some embodiments, the mold shape may be totally closed and allow for injection filling of close celled foam rather than using the stop plate method.

Figure 29:
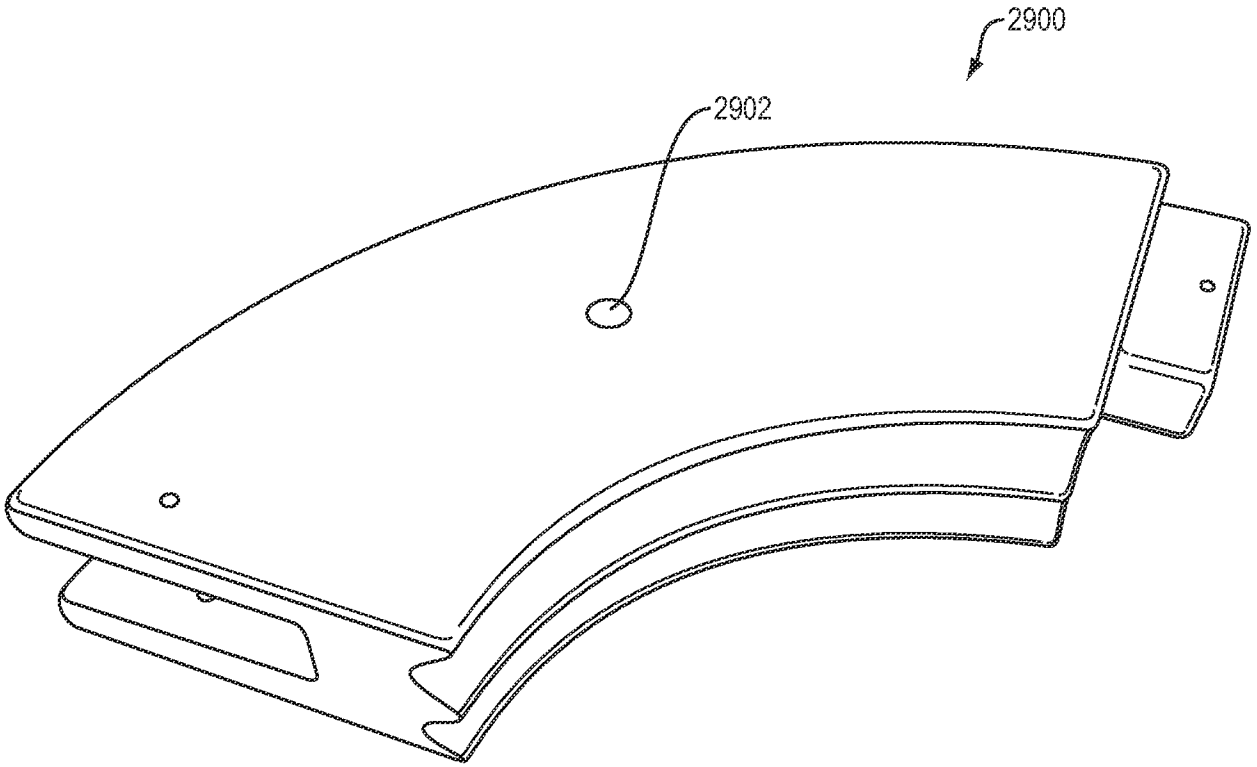
FIG. 29 is a perspective view illustrating the inverted interlocking insulation form according to one embodiment of the present invention providing protection of the foam from backfilled soil and surface water.

FIG. 29 shows the inverted interlocking insulation form 2900 provides protection of the foam from backfilled soil and surface water. The foam injection hole 2902 in the center of the block may be used to fill the mold with foam insulation.

Figure 30:
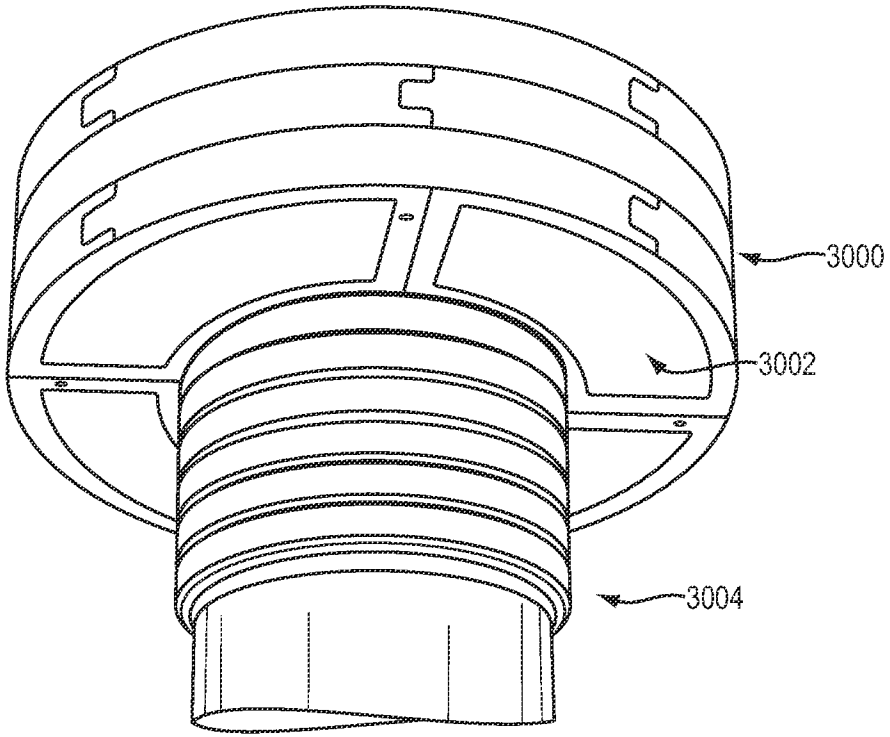
FIG. 30 is a perspective view illustrating interlocking insulation blocks configured according to one embodiment of the present invention installed in single or multiple courses as may be required to meet site conditions.

FIG. 30 illustrates interlocking insulation blocks 3000 which may be installed in single or multiple courses as may be required to meet site conditions. Foam insulation 3002 is also shown. Blocks are typically placed on offset or staggered vertical joints around pump chamber 3004 to provide added support and greater insulation value. The completed exterior insulation block system may be buried in accordance with proper installation practices.

Figure 31:
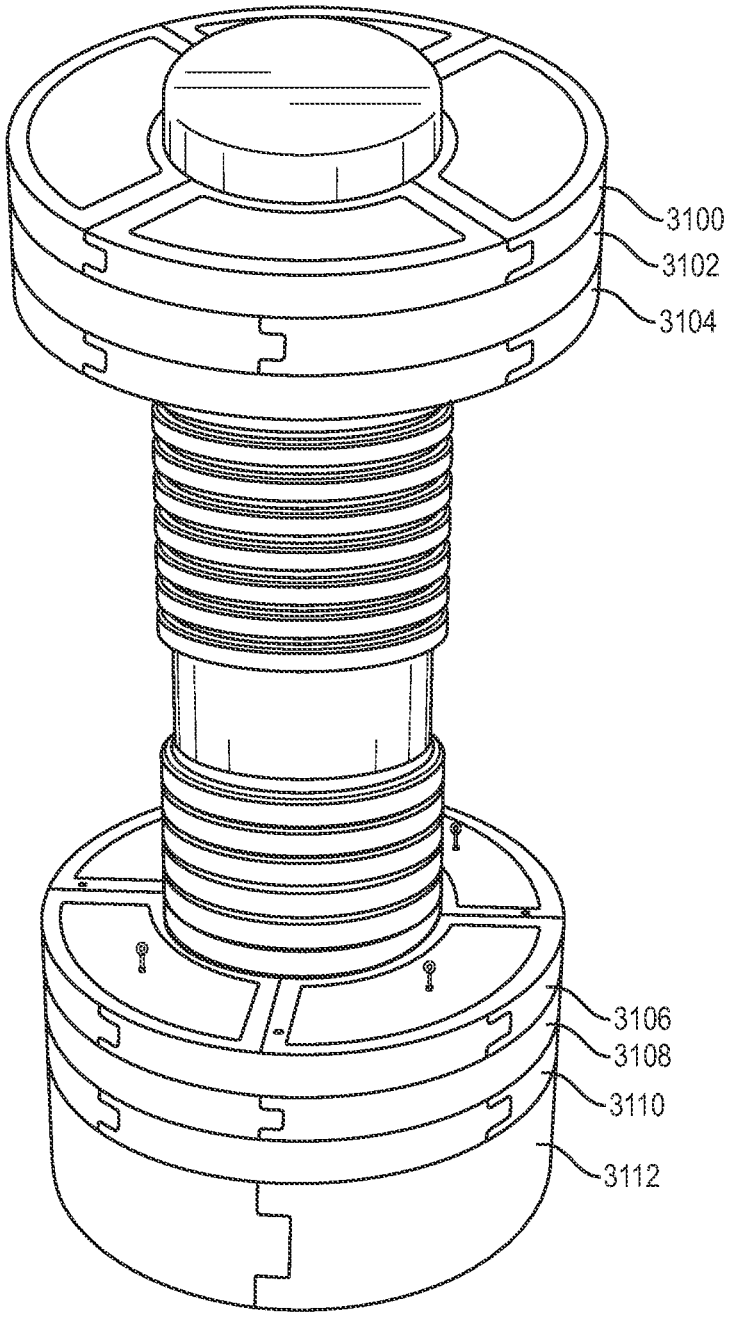
FIG. 31 is a perspective view illustrating a system of ballast blocks and ballast riser blocks in the lower portion of the preformed pump chamber configured according to one embodiment of the present invention.

FIG. 31 shows a system of ballast blocks 3112 and ballast riser blocks 3110, 3108, 3106 in the lower portion of the preformed pump chamber. The upper portion shows a series of 3 courses of interlocking insulation blocks 3104, 3102, 3100.

Figure 32:
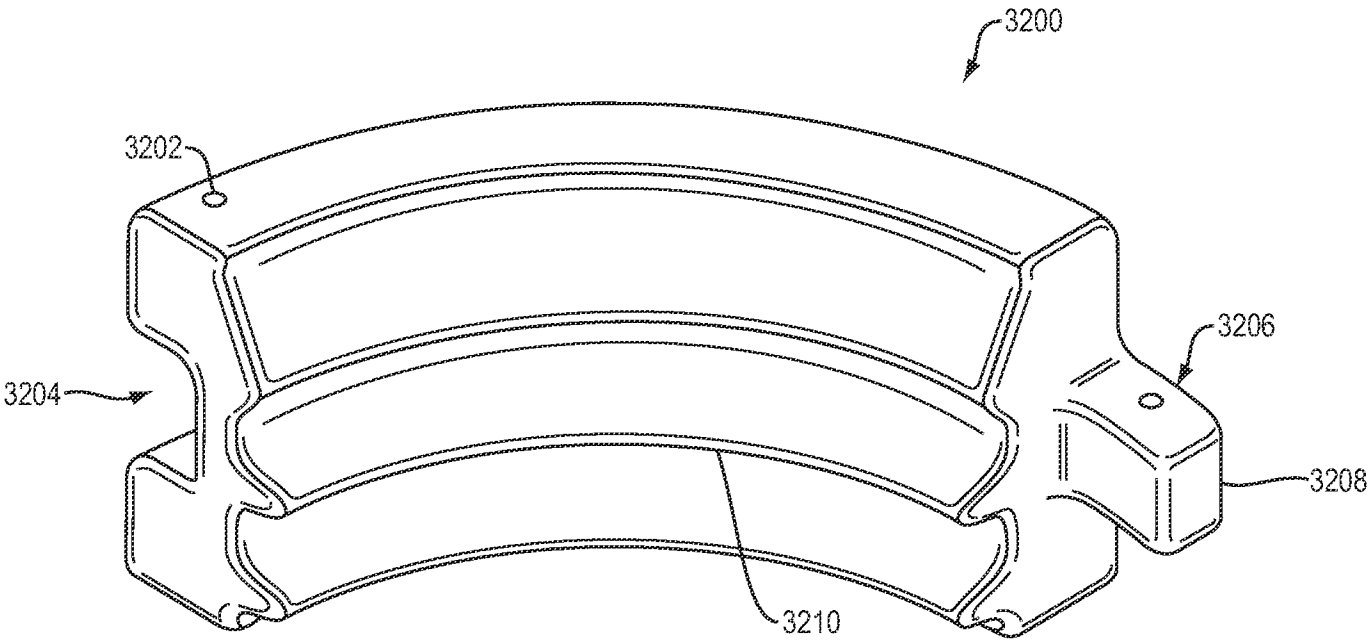
FIG. 32 is a perspective view illustrating the interior of an interlocking single ballast block section according to one embodiment of the present invention.

FIG. 32 illustrates the interior of an interlocking single ballast block section 3200 according to an embodiment of the invention. Shown are female end 3204, female end locking pin sleeve 3202, conforming surface 3210, male end 3208 and male end locking pin sleeve 3206

Figure 33:
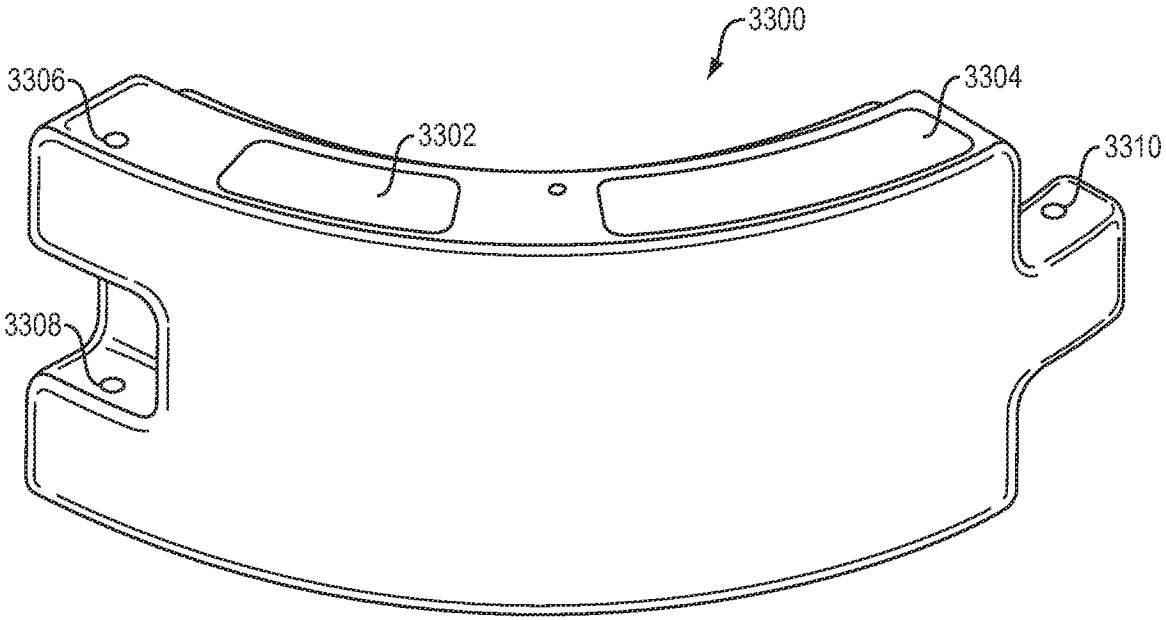
FIG. 33 is a perspective view illustrating the exterior of an interlocking single ballast block section according to one embodiment of the present invention.

FIG. 33 illustrates the exterior of an interlocking single ballast block section 3300 according to an embodiment of the invention. Shown are female end locking pin sleeves 3306 and 3308, fill cavity openings 3302 and 3304 and male end locking pin sleeve 3310. The smooth outer surface of block section 3300 could be embossed with a raised lettering logo to provide additional structural stability to the form during manufacturing prior to being filled.

Figure 34:
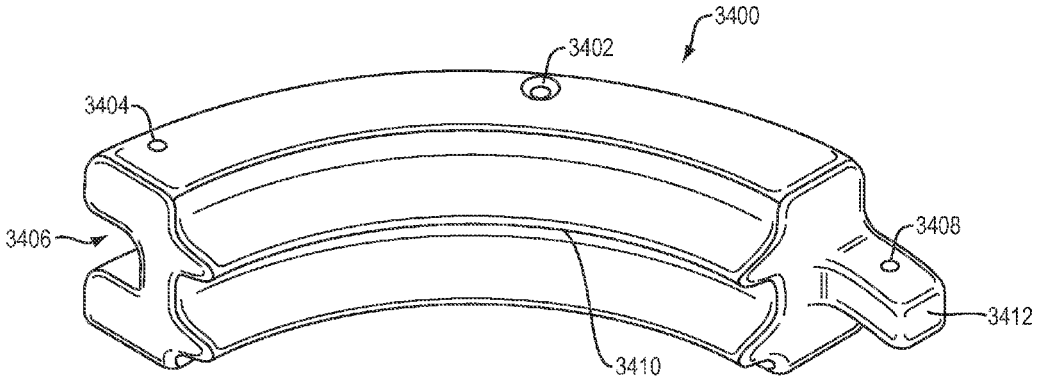
FIG. 34 is a perspective view illustrating the interior of an interlocking single riser block section according to one embodiment of the present invention.

FIG. 34 illustrates the interior of an interlocking single riser block section 3400 according to an embodiment of the invention. Shown are foam injection hole 3402, female end 3406, female end locking pin sleeve 3404, conforming surface 3410, male end 3408 and male end locking pin sleeve 3412.

Figure 35:
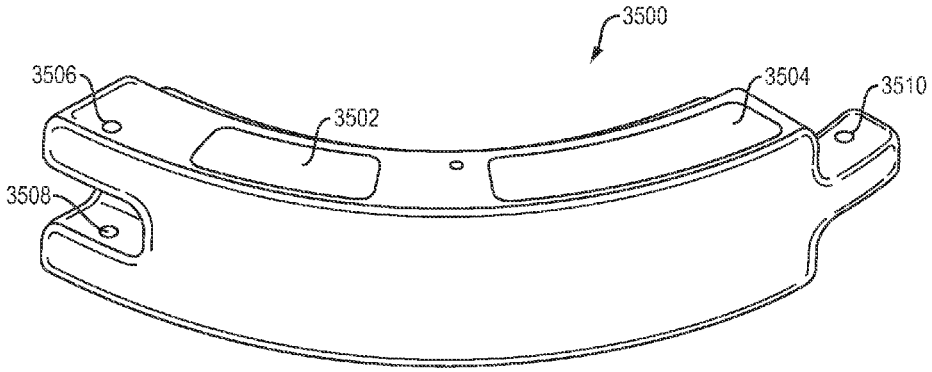
FIG. 35 is a perspective view illustrating the exterior of an interlocking single riser block section according to one embodiment of the present invention.

FIG. 35 illustrates the exterior of an interlocking single riser block section 3500 according to an embodiment of the invention. Shown are female end locking pin sleeves 3506 and 3508, fill cavity openings 3502 and 3504 and male end locking pin sleeve 3510. The smooth outer surface of block section 3500 could be embossed with a raised lettering logo to provide additional structural stability to the form during manufacturing prior to being filled.

Figure 37:
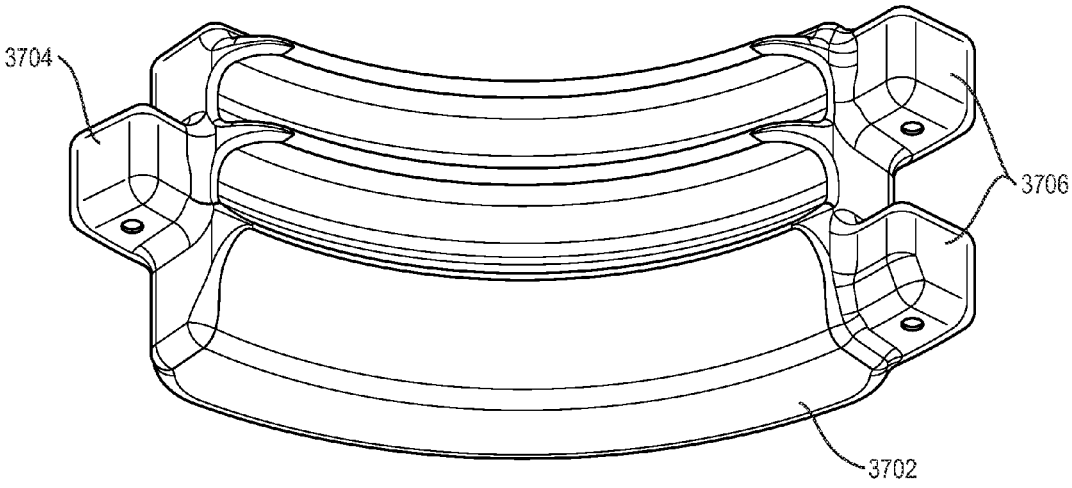
FIG. 37 is a perspective view illustrating a ballast block with an flat bottom configured according to one embodiment of the present invention.

As illustrated in FIG. 37, a ballast form may be provided with a flat bottom, configured for operation with an anchor such as that of FIG. 36. Such a block has a flat bottom 3702, and in one embodiment, the interlock between blocks is provided by interlocking tongues 3704 and 3706, operating in an analogous way to male and female interlocks discussed above. One skilled in the art would appreciate that riser blocks of analogous structure could also be provided.

As will be realized, the invention is capable of other and different embodiments, and its several details are capable of modifications in various obvious respects, all without departing from the essence of the invention. For instance, the invention may be practiced as a system and/or method, and can be scaled. There is within the scope of the invention, a system for providing ballast to an at least partially buried preformed chamber, comprising at least one ring formed of a plurality of interlocking ballast block ring segments. Each ring segment may be configured with at least one male interconnect and at least one female interconnect, and each female interconnect being configured to receive a corresponding male interconnect. Each ring segment comprises a containment form shell and cast mass. Corrosion resistant locking pins secure each female interconnect to a corresponding male interconnect. The containment form shell may be fabricated from high density polyethylene, composite resin PVC, or blow molded thermoplastic resin. A placement handle comprising a removable ring received in a lifting bolt disposed within the cast mass is provided to aid in the lowering and placement of the ring segment. A conforming profile is disposed about an internal circumference of the rings conforming to a sidewall of the preformed chamber. The containment form has an aperture in a top wall for the introduction of casting material. The bottom wall of each ring segment may have an indent formed by a projection of the bottom wall into the ring segment. Additional rings may be stacked above the at least one ring to provide additional ballast.

Additional insulation rings may be further placed above the ballast rings. The insulation rings are formed of a plurality of interlocking insulation block ring segments where each segment comprises a containment form shell and insulating foam.

There is further within the scope of the invention, a method for providing ballast to an at least partially buried preformed chamber, comprising providing at least one ring formed of a plurality of interlocking ballast block ring segments; configuring each ring segment with at least one male interconnect and at least one female interconnect, each female interconnect being configured to receive a corresponding male interconnect, each ring segment comprising a containment form shell and cast mass; and securing each female interconnect to the corresponding male interconnect with corrosion resistant locking pins. The method further comprising providing a placement handle with a removable ring received in a lifting bolt disposed within the cast mass, and disposing a conforming profile about an internal circumference of the at least one ring conforming to a sidewall of the preformed chamber. Casting material may be introduced into the containment form through an aperture in a top wall of the containment form.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A system for providing ballast to an at least partially buried preformed chamber, the system comprising:

at least one ring formed of a plurality of interlocking ballast block ring segments;

each said ring segment being configured with at least one male interconnect and at least one female interconnect, said each said female interconnect being configured to receive a corresponding male interconnect, each said ring segment comprising a containment form shell and cast mass;

a removable placement handle received by a lifting bolt disposed within said cast mass; and corrosion resistant locking pins disposed through said female interconnect and whereby each said female interconnect is secured to said corresponding male interconnect.

2. The system of claim 1 wherein said containment form shell comprises high density polyethylene.

3. The system of claim 1 wherein said containment form shell comprises composite resin PVC.

4. The system according to claim 1 wherein said containment form shell comprises a blow molded thermoplastic resin.

5. The system of claim 1 further comprises a conforming profile disposed about an internal circumference of said at least one ring conforming to a sidewall of said preformed chamber.

6. The system according to claim 1 wherein said containment form has an aperture in a top wall for the introduction of casting material into said containment form.

7. The system of claim 1 further comprising an indent in a bottom wall of each said ring segment formed by a projection of said bottom wall into said ring segment.

8. The system of claim 1 further comprising additional rings stacked above the at least one ring to provide additional ballast.

9. The system of claim 1 further comprising at least one insulation ring formed of a plurality of interlocking insulation block ring segments.

10. The system of claim 9 wherein the insulation block ring segments comprise a containment form shell to contain insulating foam.

11. A method for providing ballast to an at least partially buried preformed chamber, the method comprising:

providing at least one ring formed of a plurality of interlocking ballast block ring segments;

configuring each said ring segment with at least one male interconnect and at least one female interconnect, said each said female interconnect being configured to receive a corresponding male interconnect, each said ring segment comprising a containment form shell and cast mass and a removable placement handle received by a lifting bolt disposed within said cast mass; and securing each said female interconnect to said corresponding male interconnect with corrosion resistant locking pins.

12. The method of claim 11 further comprising disposing a conforming profile about an internal circumference of said at least one ring conforming to a sidewall of said preformed chamber.

13. The method of claim 11 further comprising introducing casting material into said containment form through an aperture in a top wall of said containment form.

14. The method of claim 11 further comprising stacking additional rings above the at least one ring to provide additional ballast.

15. The method of claim 11 further comprising disposing at least one insulation ring formed of a plurality of interlocking insulation block ring segments.

16. The method of claim 15 wherein the insulation block ring segments comprise a containment form shell to contain insulating foam.

17. The method of claim 11 wherein said containment form shell comprises at least one of high density polyethylene, composite resin PVC and blow molded thermoplastic resin.

* * * * *